US011779140B2

(12) United States Patent
Stone et al.

(10) Patent No.: US 11,779,140 B2
(45) Date of Patent: Oct. 10, 2023

(54) AERATING DRINKING STRAW

(71) Applicants: Confident Smiles, LLC, Boston, MA (US); Alice E. Stone, Boston, MA (US); Jacob Dylan Freake, Somerville, MA (US); Paul Sabin, Needham, MA (US); Mark Dockser, Reading, MA (US)

(72) Inventors: Alice E. Stone, Boston, MA (US); Jacob Dylan Freake, Somerville, MA (US); Paul Sabin, Needham, MA (US); Mark Dockser, Reading, MA (US)

(73) Assignee: Confident Smiles, LLC, Boston, MA (US)

( * ) Notice: Subject to any disclaimer, the term of this patent is extended or adjusted under 35 U.S.C. 154(b) by 263 days.

(21) Appl. No.: 16/762,025

(22) PCT Filed: Nov. 2, 2018

(86) PCT No.: PCT/US2018/058942
§ 371 (c)(1),
(2) Date: May 6, 2020

(87) PCT Pub. No.: WO2019/090064
PCT Pub. Date: May 9, 2019

(65) Prior Publication Data

US 2021/0186243 A1 Jun. 24, 2021

Related U.S. Application Data

(60) Provisional application No. 62/581,988, filed on Nov. 6, 2017.

(51) Int. Cl.
*A47G 21/18* (2006.01)

(52) U.S. Cl.
CPC ..... *A47G 21/183* (2013.01); *A47G 21/185* (2013.01)

(58) Field of Classification Search
CPC ... A47G 21/183; A47G 21/185; A47G 21/187
See application file for complete search history.

(56) References Cited

U.S. PATENT DOCUMENTS 6,460,777 B2 10/2002 Float
7,537,173 B1 5/2009 Kogan
(Continued)

FOREIGN PATENT DOCUMENTS

WO 2016/138084 A1 9/2016

*Primary Examiner* — Steven M Cernoch
(74) *Attorney, Agent, or Firm* — PRETI FLAHERTY BELIVEAU & PACHIOS LLP

(57) ABSTRACT

Drinking straws for aerating fluids are described. A straw includes a body and a cover. The body defines a flow space and an aeration area. The cover includes an aeration opening and a movable barrier. The cover encloses the body and the movable barrier can move between a first position occluding the aeration area and a second position exposing a portion of the aeration area. The straw body and the straw cover, when in the second position, enable air flow through the exposed portion of the aeration area so as to aerate fluid flowing through the flow space. The straw body and the straw cover dampen sound created by the aeration of the fluid when in the second position. The movable barrier may be a plug or a slider.

16 Claims, 21 Drawing Sheets

(56) References Cited

U.S. PATENT DOCUMENTS

| | | | | |
|---|---|---|---|---|
| 2007/0039960 | A1* | 2/2007 | Pawlik | B65D 51/18<br>220/254.7 |
| 2014/0166680 | A1* | 6/2014 | St. Gelais | A47G 21/183<br>220/710 |

* cited by examiner

AERATING DRINKING STRAW

STATEMENT REGARDING FEDERALLY SPONSORED RESEARCH OR DEVELOPMENT

N/A

TECHNICAL FIELD

Various embodiments relate generally to drinking straws and, more specifically, relate to drinking straws that aerate a fluid.

BACKGROUND

This section is intended to provide a background or context. The description may include concepts that may be pursued, but have not necessarily been previously conceived or pursued. Unless indicated otherwise, what is described in this section is not deemed prior art to the description and claims and is not admitted to be prior art by inclusion in this section.

Beverages can be served in a variety of containers. Some containers include straws which are intended to last as long as the container. However, such straws are not suitable for all beverages and uses. For example, a travel mug with a straw can be dangerous when drinking hot tea as the drinker may inadvertently burn themselves.

Additionally, drinkers may wish to alter how they drink a beverage. After whitening, teeth can be extremely vulnerable to new staining. Accordingly, a person may wish to drink coffee through a straw in order to minimize the coffee's contact with their teeth. However, there is a risk they may scald their soft palate or tongue.

What is needed is a way for the drinker to control the temperature of fluids going through the straw.

BRIEF SUMMARY OF THE INVENTION

The below summary is merely representative and non-limiting.

The above problems are overcome, and other advantages may be realized, by the use of the embodiments.

In a first aspect, an embodiment provides a straw for aerating fluids. The straw includes a body and a cover. The body defines a flow space and an aeration area. The cover includes an aeration opening and a movable barrier. The cover is configured to enclose the body and the movable barrier can move between a first position occluding the aeration area and a second position exposing a portion of the aeration area. The straw body and the straw cover, when in the second position, enable air flow into the flow space through the exposed portion of the aeration area so as to aerate fluid flowing through the flow space. The straw body and the straw cover dampen sound created by the aeration of the fluid when in the second position. The movable barrier may be a plug or a slider.

BRIEF DESCRIPTION OF THE SEVERAL VIEWS OF THE DRAWINGS

Aspects of the described embodiments are more evident in the following description, when read in conjunction with the attached Figures.

DETAILED DESCRIPTION

This patent application claims priority from US Provisional Patent Application No.: 62/581,988, filed Nov. 6, 2017, the disclosure of which is incorporated by reference herein in its entirety.

Various embodiments provide means for controlling the temperature of fluids going through a straw. In one embodiment, a straw includes aeration holes which allow the user to aerate the fluid with ambient air, for example, to cool down hot liquids. Further embodiments enable the user to further control the amount of aeration, such as by controlling the number of aeration holes that are covered or uncovered. In some embodiments, the straw and wrapper are configured such that in a default state the maximum aeration is provided so as to prevent accidentally burning or scalding of the user.

Reference will now be made in detail to various embodiments, examples of which are illustrated in the accompanying drawings.

As used herein, "holes" can mean any structure or openings that permits movement of air or other fluid through. Similarly, "slot" can mean one or more openings that allow air or other fluid to pass through. As such, "holes" or "slots" may include additional features, for example, a "mesh" or "screen" which covers the opening while allowing air or other fluid to pass through. A hole is considered "uncovered" when air is allowed to flow through the hole even though the hole may be obscured by another structure, for example, by a mesh or a cover which allows air to flow around the sides of the cover.

Figure 1:
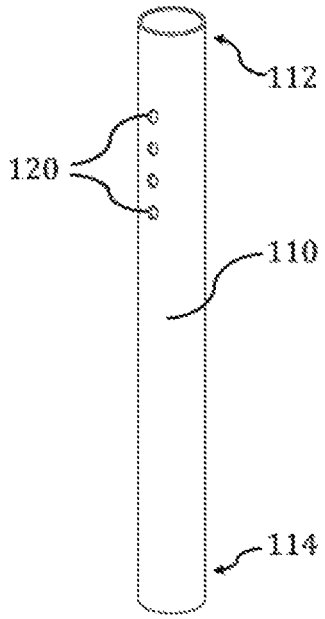
FIG. 1 shows an isometric view of a straw in accordance with a first embodiment.

FIG. 1 shows a straw 110 of a first embodiment. Straw 110 is similar to a standard drinking straw, but has a series of aeration holes 120 defined towards an upper end 112 thereof. Aeration holes 120 allow air to enter the straw when negative pressure is applied to the upper end 112 of the straw 110 when lower end 114 of the straw 110 is submerged in a liquid.

Figure 2:
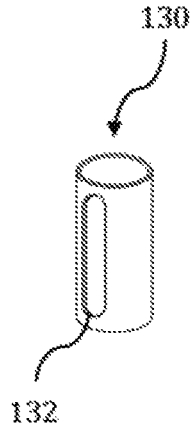
FIG. 2 shows an isometric view of a collar in accordance with the first embodiment.
Figure 3A:
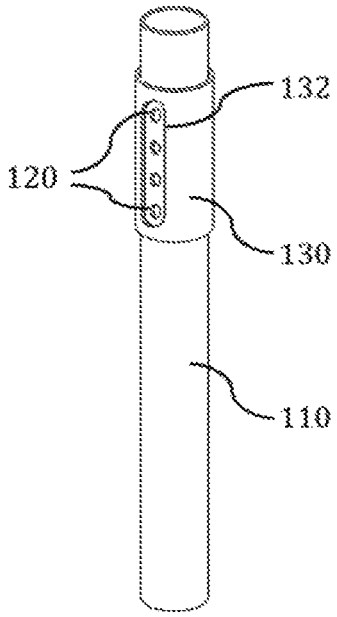
FIGS. 3A-3B, collectively referred to as FIG. 3, shows isometric views of the combined straw and collar in accordance with the first embodiment.
Figure 3B:
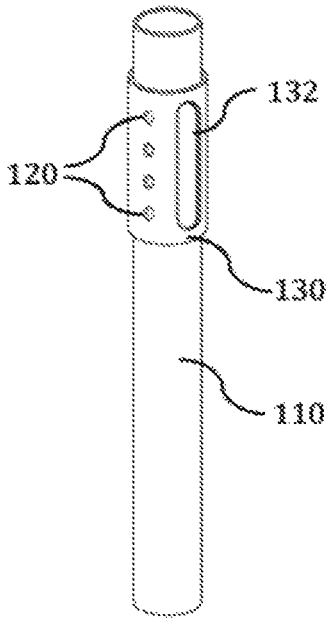

FIG. 2 shows a collar 130 according to an embodiment. Collar 130 fits onto straw 110 such that it is able to slide thereon. Collar 130 defines a slot 132 that roughly corresponds to aeration holes 120 when collar 130 is installed on straw 110 as shown in FIG. 3A. Collar 130 can also be rotated so that slot 132 is not disposed over aeration holes 120, as shown in FIG. 3B, thereby occluding the holes and blocking air from entering straw 110 through aeration holes 120.

Figure 4A:
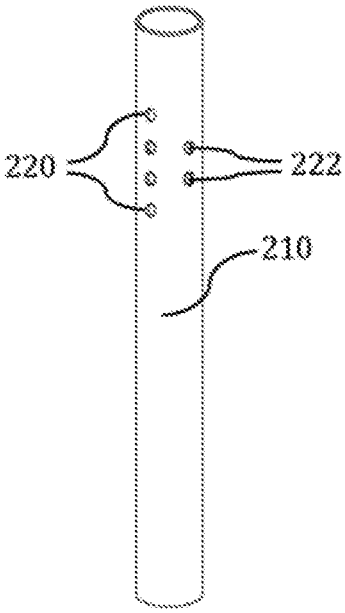
FIGS. 4A-4C, collectively referred to as FIG. 4, show isometric views of straws and collars in accordance with additional embodiments.

FIG. 4A shows another embodiment where straw 210 has a multiple sets of aeration holes including first aeration holes 220 having a first maximum airflow rate, and second aeration holes 222 having a second maximum airflow rate. While only two sets of aerations holes are shown, it is contemplated that more than two sets of holes can be used, or alternatively a single set of holes that have different maximum airflow rates depending on the circumferential location of slot 132 as collar 130 is rotated about straw 210.

Figure 4B:
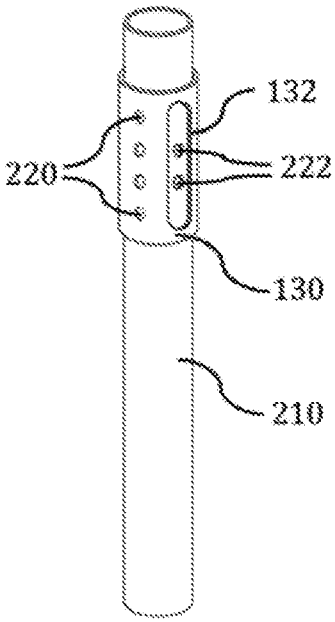

FIG. 4B shows collar 130 on straw 210, where slot 132 is aligned with second aeration holes 222, with first aeration holes 220 covered by the remaining structure of collar 130. In this configuration, collar 130 restricts the air rate to that of the second maximum airflow rate. Collar 130 can alternatively be positioned such that slot 132 is aligned with first aeration holes 220, with second aeration holes 222 covered by the rest of the collar 130. While not shown, the collar may also be positioned so that no aeration holes 220, 222 are aligned with the slot 132, similar to as shown in FIG. 3B.

Figure 4C:
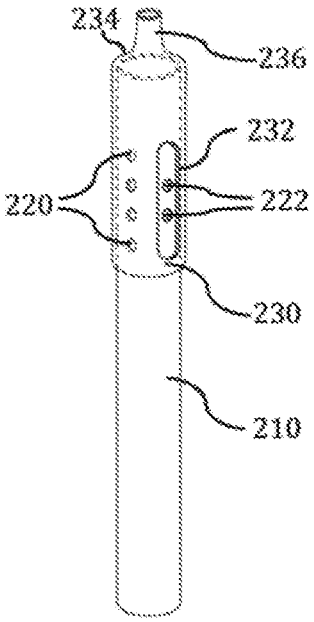

FIG. 4C shows an alternative collar 230 having a slot 232 similar to slot 132 in collar 130, but also has a shoulder 234 that limits the movement of collar 230 along the axis of straw 210. Shoulder 234 also defines a mouthpiece 236 through which a fluid can flow. With this collar 230, a user's teeth can contact shoulder 234 with the opening of mouthpiece 236 extending beyond an inside surface of a user's teeth so that a staining beverage does not stain the front surface of a user's teeth. Mouthpiece 236 can be formed so as to disperse fluid across a wide area of a user's mouth to help reduce chances of burning the user's mouth when a hot fluid is utilized.

Figure 5:
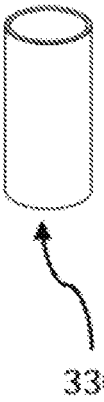
FIG. 5 shows an isometric view of a collar in accordance with the further embodiment.
Figure 6A:
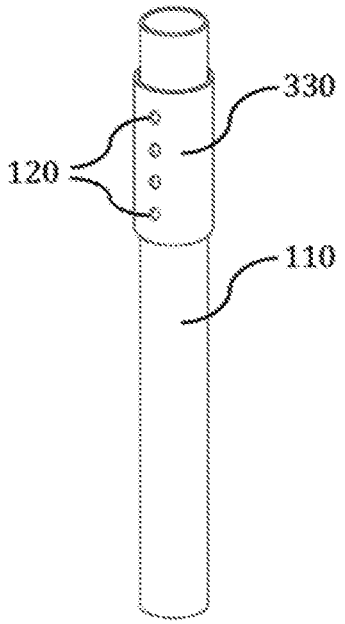
FIGS. 6A-6C, collectively referred to as FIG. 6, show a combination of the collar from FIG. 5 and the straw from FIG. 1 in accordance with a further embodiment.
Figure 6B:
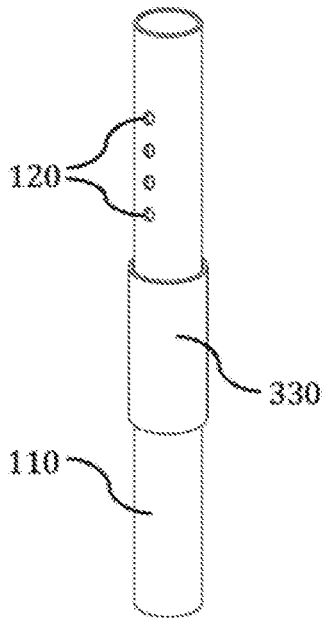
Figure 6C:
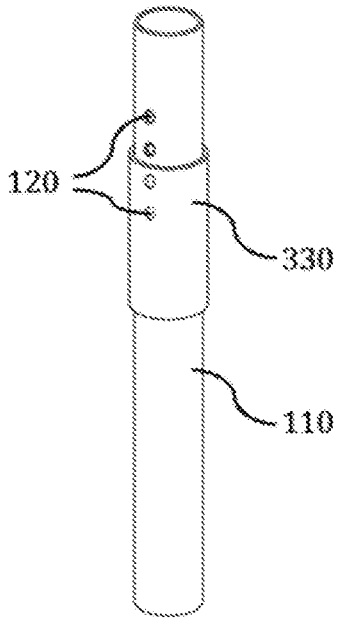

FIG. 5 shows another embodiment of a collar 330 that does not include a slot. FIG. 6A shows collar 330 installed on straw 110 such that aeration holes 120 are completely blocked by collar 330, allowing no air to flow through them. FIG. 6B shows collar 330 positioned on straw 110 so that all of the aeration holes 120 are uncovered, allowing a maximum airflow rate through. FIG. 6C shows collar 330 slid to partially cover aeration holes 120, allowing an intermediate airflow rate through. While FIG. 6C shows collar 330 covering two out of four of the aeration holes 120, it is possible to cover more or fewer of the aeration holes to adjustably control the airflow rate.

FIG. 7 shows the embodiment of FIG. 6 in use. Straw 110 having collar 330 installed thereon is lowered into a container (or cup) 400 having fluid (or liquid) 440 contained therein so that lower end 114 of straw 110 is below the surface of liquid 440.

Figure 7A:
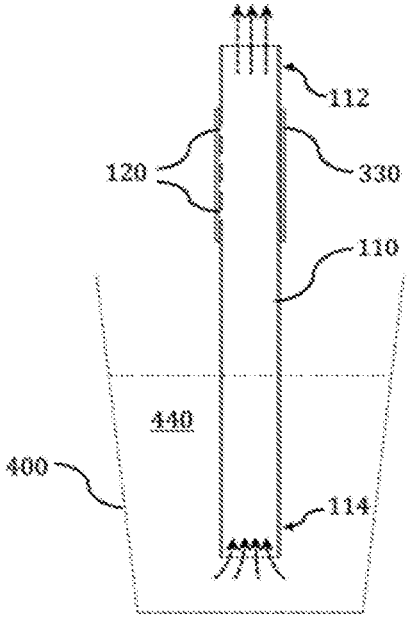
FIGS. 7A-7B, collectively referred to as FIG. 7, show a cross section of the third embodiment shown in FIG. 6.

In FIG. 7A, collar 330 is covering all of the aeration holes 120. When negative pressure is applied to an upper end 112 of straw 110 fluid 440 is drawn into the straw 110 as if the straw 110 were a typical straw with no aeration holes.

Figure 7B:
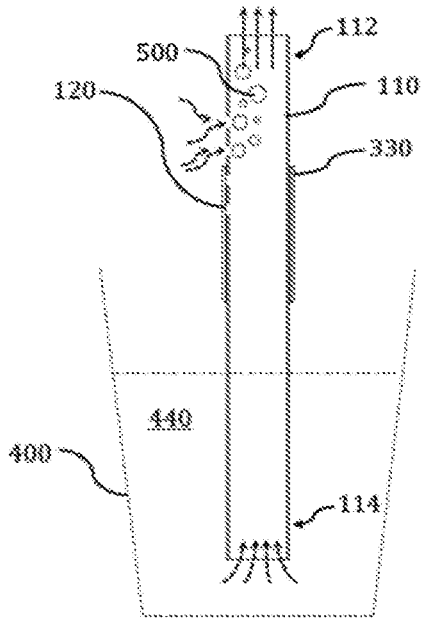

In FIG. 7B, aeration holes 120 are partially covered by collar 330, such as shown in FIG. 6C. As negative pressure is applied to upper end 112 of straw 110, fluid is drawn up from the lower end 114 of the straw 110, but because the aeration holes 120 are exposed to the atmosphere, air is drawn into aeration holes 120 and forms bubbles 500 in fluid 440 drawn through the straw 110. If the ambient air is at a lower temperature than fluid 440, bubbles 500 will lower the temperature of fluid 440. Also, letting air into the fluid stream lowers the effective flow rate of the liquid 440 through straw 110, decreasing the amount of fluid entering the user's mouth at any one time. For hot fluids 440, the decreased flow rate and introduction of air bubbles 500 will help to prevent burning a user's mouth.

The embodiments of FIGS. 1-4 operate similarly to the methods portrayed in FIG. 7 in that adjusting collar 130 or 230 to selectively cover aeration holes 120, 220, 222 affects the temperature and flow rate of fluid 440 passing through straws 110 or 210.

Straws 110, 210 may be made of durable material that can withstand multiple cycles of a dishwasher. Such materials include porcelain, ceramics, metal, glass, borosilicate glass, hard plastics, stone, or other durable materials.

Collars 130, 230 may be made of either durable or pliant/elastic materials (or a combination of both). Such durable materials include porcelain, ceramics, metal, glass, borosilicate glass, hard plastics, stone, or other durable materials. Alternatively, collars 130, 230 may be made of more pliant materials, such as rubber, nylon, etc.

Additionally, the straws 110, 210 may include subcomponents, such as a tube portion and a mouthpiece portion. Each subcomponent may be made of the same material or of different materials, for example, the tube portion may be made of hard plastic of one color and the mouthpiece portion may be made of hard plastic of another color, or the tube portion may be made of metal and the mouthpiece portion may be made of hard plastic.

In one non-limiting embodiment, the material contacting a user's mouth may have a low thermal conductivity coefficient so that the outside surface of the straw or collar does not get as hot as the fluid traveling through. A high specific heat capacity is also desired to initially lower the temperature of a hot fluid 440 as the material absorbs heat, and holding onto the heat to help maintain the temperature of the fluid 440.

Straws 110, 210 can further be made with a layer of insulation that can maintain the temperature of fluid 440 while protecting the user from being burned.

Figure 8:
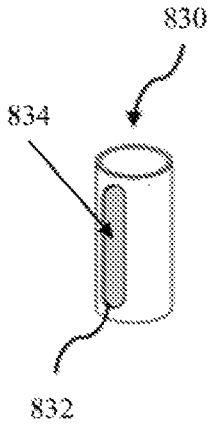
FIG. 8 shows an isometric view of a collar in accordance with a fourth embodiment.

FIG. 8 shows an isometric view of a collar 830 in accordance with a fourth embodiment. This slotted collar 830 is similar to the collar 130 shown in FIG. 2. However, collar 830 includes a mesh 834 which fills slot 832. This mesh 834 allows the creation of many tiny bubbles 500 to form in a fluid. The high surface area of these bubbles 500 helps to efficiently cool the fluid. Additionally, the creation of many tiny bubbles 500 also assists in reducing any noise produced by the formation of the bubbles 500.

In further, non-limiting embodiments, the mesh 834 may be a screen, porous material, air-permeable membrane or other structure which facilitates the creation of many tiny bubbles 500, such as a porous plastic, porous polymer fibers, porous glass fibers, Porex or Tyvek.

Figure 9:
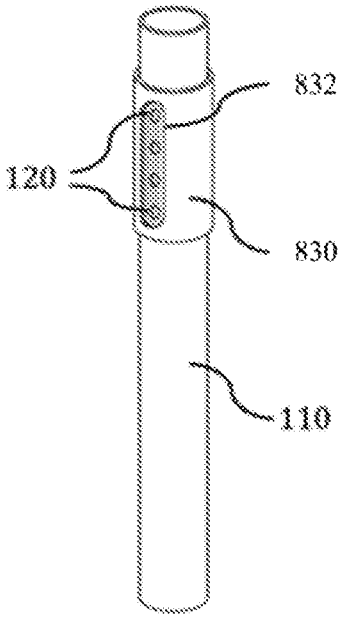
FIG. 9 shows an isometric view of a straw and collar in accordance with the fourth embodiment.

FIG. 9 shows an isometric view of a straw 110 and collar 830 in accordance with the fourth embodiment. In this embodiment which is similar to that shown in FIG. 3A, the collar 830 is used with straw 110. The slot 832 is positioned over the holes 120 so that air may be brought though the mesh 834 into a fluid flowing through the straw 110. Additionally, the collar 830 may be made from an elastic material so as to hold the mesh 834 taut against the outer surface of the straw 110.

Figure 10:
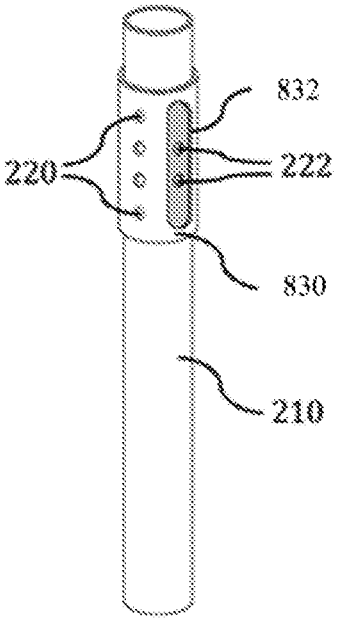
FIG. 10 shows another isometric view of a straw and collar in accordance with the fourth embodiment.

FIG. 10 shows another isometric view of a straw 210 and collar 830 in accordance with the fourth embodiment. Similar to the embodiment shown in FIG. 4B, the collar 830 is aligned so that it covers first aeration holes 220 and allows air to flow through the mesh 834 in slot 832 into second aeration holes 222.

Figure 11:
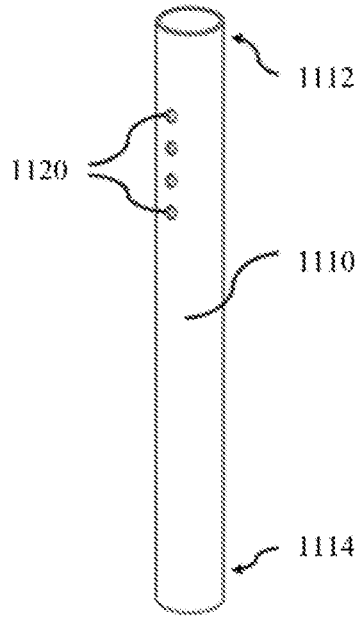
FIG. 11 shows an isometric view of a straw in accordance with a fifth embodiment.

FIG. 11 shows an isometric view of a straw 1110 in accordance with a fifth embodiment. In this embodiment, a straw 1110, similar to straw 110 of FIG. 1, includes an upper end 1112 and a lower end 1114. Aeration holes 1120 are located mid-way along the length of the straw 1110.

Here, the aeration holes 1120 include a mesh covering the opening. In one, non-limiting embodiment, the mesh may be embedded in the material of the straw 1110. In further, non-limiting embodiments, the material of the straw 1110 itself may include an array of tiny openings, or an air-permeable surface, such as a porous plastic, porous polymer fibers, porous glass fibers, Porex or Tyvek.

Figure 12:
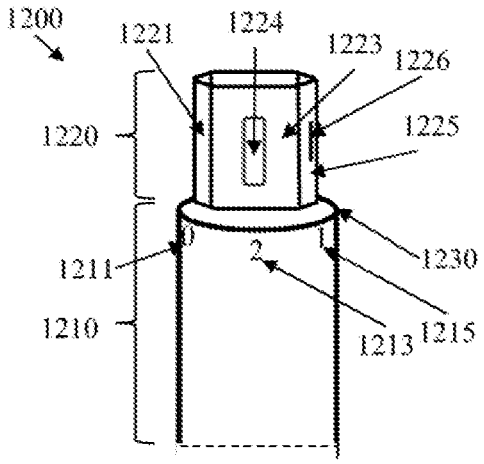
FIG. 12 shows an isometric view of a straw in accordance with a sixth embodiment.

FIG. 12 shows an isometric view of a straw 1200 in accordance with a sixth embodiment. The straw 1200 has two ends, a lower end 1210 and an upper end 1220, separated by a shoulder 1230. Various position indicators 1211, 1213, 1215 are located on the outer surface of the lower end 1210 near the shoulder 1230. As shown, there are at least three position indicators: a "0" position indicator 1211, a "2" position indicator 1213 and a "1" position indicator 1215.

The upper end 1220 includes a hexagonal prism having six facings or sides. A first side 1221 has no opening and has a rotational orientation around the axis of the straw 1200 corresponding to the "0" position indicator 1211. The second side 1223 has a large slot 1224 and has a rotational orientation corresponding to the "2" position indicator 1213. At a rotational orientation corresponding to the "1" position indicator 1215 is a third side 1225 having a small slot 1226.

Although not show, the remaining three sides may repeat this pattern of sides/openings in one, non-limiting embodiment. In further embodiments, the other sides may include different sized openings with corresponding position indicators.

Figure 13:
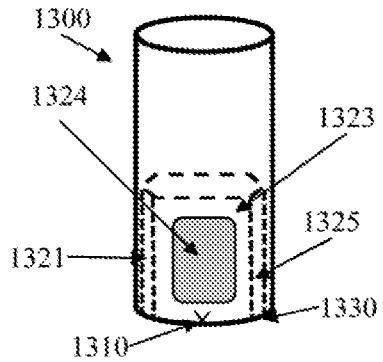
FIG. 13 shows an isometric view of a collar in accordance with the sixth embodiment.

FIG. 13 shows an isometric view of a collar 1300 in accordance with the sixth embodiment. The collar 1300 is constructed with interior surfaces (shown with dashed lines) which correspond to the sides of upper end 1220. First interior side 1321, second interior side 1323 and third interior side 1325 are similarly sized and match every side of upper end 1220. As shown, second interior side 1323 includes a mesh 1324 which allows air to flow through it. Collar 1300 also includes a pointer 1310 located near edge 1330.

Figure 14:
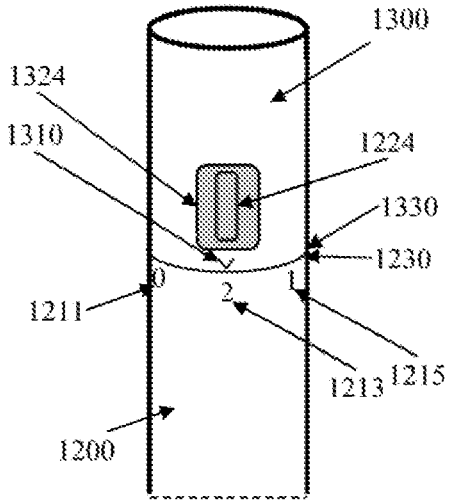
FIG. 14 shows an isometric view of the straw and collar in accordance with the sixth embodiment.

FIG. 14 shows an isometric view of the straw 1200 and collar 1300 in accordance with the sixth embodiment. The collar 1300 is placed over the upper end 1220 so that second interior side 1323 abuts the second side 1223. In this orientation, mesh 1324 covers large hole 1224 so that air can flow into a fluid moving through the straw 1200 and collar 1300.

Pointer 1310 near edge 1330 provides a visual cue as to the rotational orientation. In this orientation, the mesh 1324 allows air through the large slot 1224 and the pointer 1310 points to the "2" position indicator 1213.

Should the collar 1300 be rotated clockwise so that the second interior side 1323 abuts first side 1221 which has no opening, the pointer 1310 would point to the "0" position indicator 1211. Likewise, if the collar 1300 were rotated counter-clockwise so that the mesh 1324 would allow air through the small slot 1226, the pointer 1310 would then be pointing to the "1" position indicator 1215.

In further, non-limiting embodiments, the structures located on the straw 1200 and collar 1300 may be reversed, for example, structures similar to those on the upper end 1220 may be located on a collar (or mouth piece) and cooperate with matching structures on the straw 1200. Likewise, position indicators similar to position indicators 1211, 1213, 1215 may be located on a collar while a pointer is located on a straw 1200. In other, non-limiting embodiments, the pointer 1310 and position indicators 1211, 1213, 1215 may also be replaced with other indications of orientation, for example, a collar may include a notch or opening so that a position indicator may be seen through the notch or opening.

Additionally, as described the upper end 1220 is a hexagonal prism. However, in other, non-limiting embodiments different shaped structures may be used, for example, a cylindrical structure or an octagonal prism. Furthermore, the structure of the upper end 1220 may include rounded corners or slightly curved faces in order to ease rotation of the collar 1300.

Figure 15A:
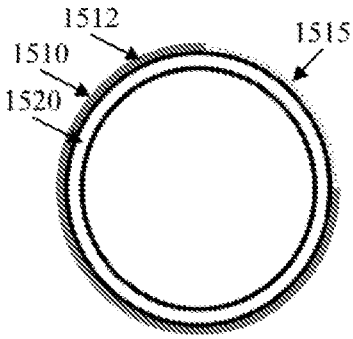
FIGS. 15A-15B, collectively referred to as FIG. 15, show cross-section views of straws and collars in accordance with additional embodiments.

FIG. 15 shows cross-section views of a straw 1520 and collars 1510, 1530 in accordance with additional embodiments. In FIG. 15A, a ring collar 1510 surrounds the straw 1520 and ensures the mesh 1515 is held against the outer surface of the straw 1520. In this non-limiting embodiment, the collar 1510 includes an elastic membrane 1512 which pulls the mesh 1515 tight. The elastic membrane 1512 is further designed to prevent air from flowing through or around it into any holes in the straw 1520 covered by the elastic membrane 1512.

Figure 15B:
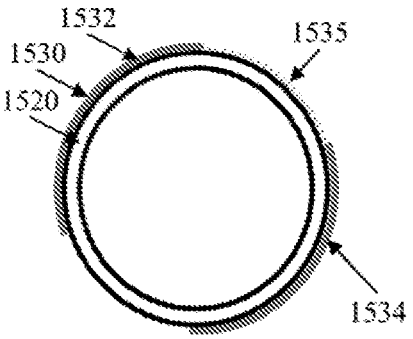

In FIG. 15B, a clamp collar 1530 surrounds the straw 1520 and ensures the mesh 1535 is held against the outer surface of the straw 1520. In this non-limiting embodiment, the clamp collar 1530 has a first clamp collar side 1532 on an end of the mesh 1515 and a second clamp collar side 1534 on the other end. The first clamp collar side 1532 and the second clamp collar side 1534 cooperate to hold the collar 1530 against the straw 1520 and prevent air from flowing through or around the collar sides 1532, 1534 into any holes in the straw 1520 covered by them.

In further embodiments, the collar and straw may have other shapes, for example, an octagonal prism shape. In such cases the collar may be malleable enough to conform to the shape of the straw and/or be shaped to match the outer surface of the straw.

Figure 16:
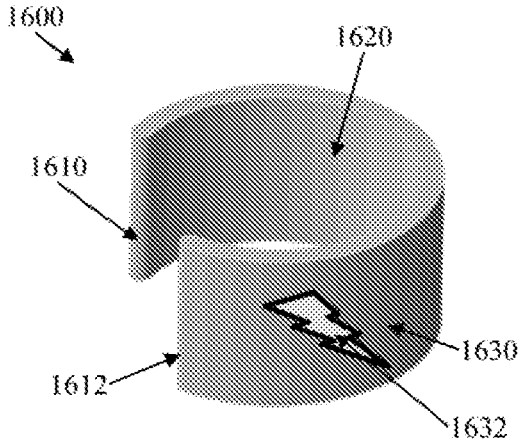
FIG. 16 shows a view of a cover in accordance with a seventh embodiment.

FIG. 16 shows a view of a cover 1600 in accordance with a seventh embodiment. The cover 1600 is designed to go around both a collar and a straw. In this non-limiting embodiment, the cover 1600 is clamp shaped cover with a first edge 1610 and a second edge 1612. These edges 1610, 1612 grip the sides of the collar/straw and hold the cover in place.

The cover 1600 includes an interior surface 1620 which may be configured to allow air to flow past the cover 1600. This may serve to dampen any sounds made by bubbles forming in the fluid passing through the straw. The cover 1600 is shown with a lightning shaped graphic 1632 on the outer surface 1630.

The cover 1600 may be made of any suitable material, for example, plastic. Additionally, the material may provide insulation so as to give the user a convenient place to hold the straw.

Figure 17:
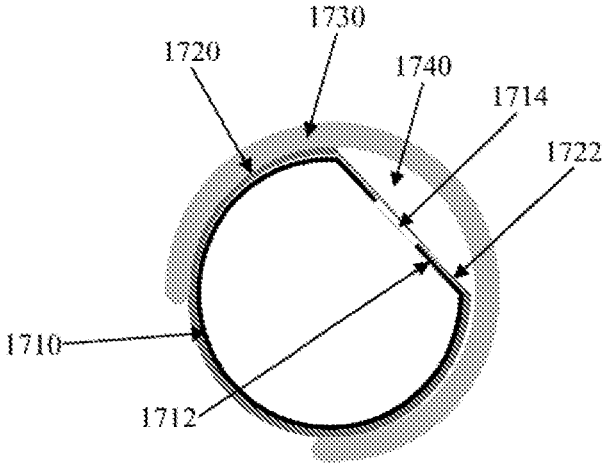
FIG. 17 shows a cross-section view of a straw, collar and cover in accordance with an eighth embodiment.

FIG. 17 shows a cross-section view of a straw 1710, collar 1720 and cover 1730 in accordance with an eighth embodiment. The straw 1710 and collar 1720 are generally cylindrical with a flat surface. The straw 1710 includes a flat surface 1712 which has an aeration hole 1714. Matching the shape of the straw 1710, the collar 1720 includes a mesh 1722 which abuts the flat surface 1712 and allows air to flow through the aeration hole 1714.

The clamp cover 1730 grips the side of the collar 1720. The cover 1730 is designed to allow an opening (or gap) 1740 to form between the inner surface of the cover 1730 and the mesh 1722. Air can flow past the cover 1730 through the opening 1740 and into the aeration hole 1714.

Figure 18:
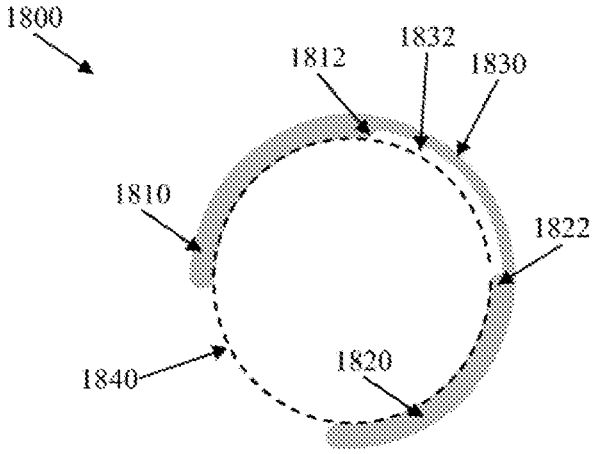
FIG. 18 shows a cross-section view of a cover in accordance with a ninth embodiment.

FIG. 18 shows a cross-section view of a cover 1800 in accordance with a ninth embodiment. In this non-limiting embodiment, the cover 1800 has a first edge 1810 with a first shoulder 1812. A second edge 1820 with shoulder 1822 is located opposite the first edge 1810. Between the shoulders 1812, 1822 is a narrow section 1830. The relatively thick structure of the edges 1810, 1820 hold the narrow section 1830 away from an inner circumference 1840 (corresponding to an outer surface of a circular straw/collar). This creates a gap 1832 through which air can flow.

In a further non-limiting embodiment, the cover may be ring cover, for example, the cover may be a solid cylinder or may include cooperating structures which allow the ends of the cover to latch together and form a closed ring.

Figure 19:
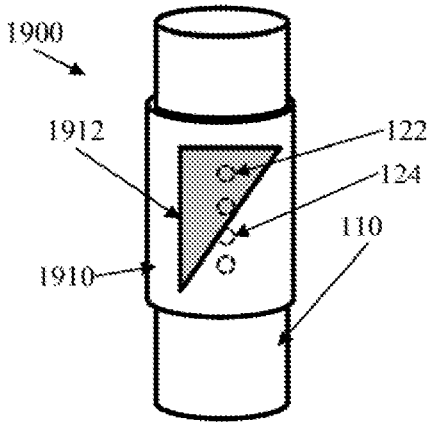
FIG. 19 shows an isometric view of a straw and collar in accordance with a tenth embodiment.

FIG. 19 shows an isometric view of a straw 110 and collar 1910 in accordance with a tenth embodiment. In this non-limiting embodiment, the collar 1910 has a triangular shaped mesh 1912 and is positioned in a partial covered configuration 1900. The mesh 1912 allows air to flow into various uncovered aeration holes 122 and the collar 1910 prevents air from flowing through covered aeration holes 124. By rotating the collar 1910 around the straw 110, more or less aeration holes 120 may be covered. This allows the user to control the amount of air entering a fluid passing through the straw 110.

In another, non-limiting embodiment, the mesh 1912 may have an alternative shape, such as a stair-shaped edge.

Figure 20A:
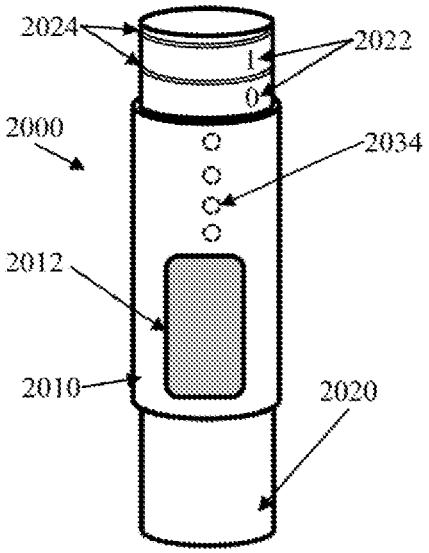
FIGS. 20A-20B, collectively referred to as FIG. 20, show isometric views of a straw and collar in accordance with an eleventh embodiment.
Figure 20B:
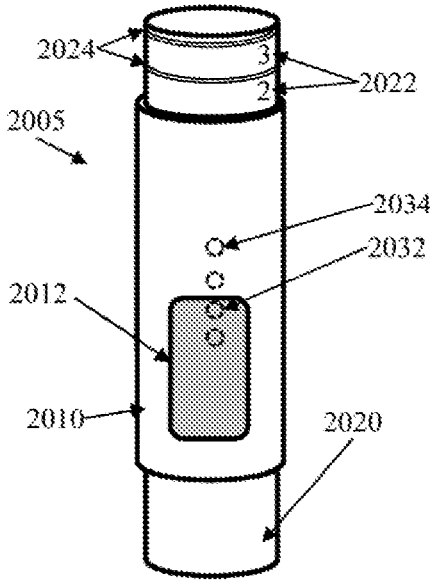

FIGS. 20A-20B, collectively referred to as FIG. 20, show isometric views of a straw 2020 and collar 2010 in accordance with an eleventh embodiment. In the fully covered configuration 2000 shown in FIG. 20A, the collar 2010 is positioned so that no aeration holes 2034 are allowed to have air flow through the mesh 2012 into a fluid moving through the straw 2020.

Straw 2020 includes position indicators 2022 and corresponding grooves 2024. A structure on the interior side of the collar 2010 may function with the grooves 2024 to retain the collar 2010 at a given position. In the fully covered configuration 2000, this position corresponds with the "0" position.

In the partial covered configuration 2005 shown in FIG. 20B, two aeration holes 2034 are covered by the collar 2010 and two uncovered aeration holes 2032 are allowed to have air flow through the mesh 2012 into a fluid moving through the straw 2020. This corresponds to a position "2" as shown by position indicators 2022.

Figure 21:
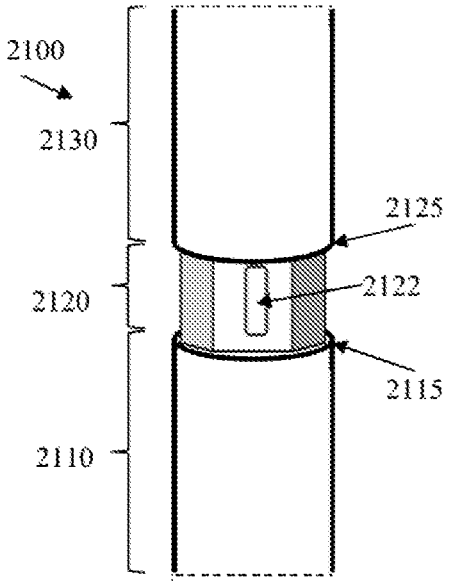
FIG. 21 shows an isometric view of a straw in accordance with a twelfth embodiment.

FIG. 21 shows an isometric view of a straw 2100 in accordance with a twelfth embodiment. The straw 2100 is separated into a lower end 2110, a mid-section 2120 and an upper end 2130. The lower end 2110 and the upper end 2130 may be identical as shown. Alternatively, the ends 2110 and 2130 may be different, for example, the lower end 2110 may be oval shaped to securely fit an opening in a lid while the upper end 2130 may be round shaped. Additionally, the ends 2110, 2130 may be made of different materials.

In this, non-limiting embodiment, the mid-section 2120 is located between shoulders 2115 and 2125. This octagonal shaped mid-section 2120 includes at least one opening 2122. A collar, such as one similar to either ring collar 1510 or clamp collar 1530 may be placed between shoulders 2115 and 2125. In such an embodiment, the ring collar 1510 may be made of a malleable material in order to be slid over upper end 2130 into place around the mid-section 2120 while still remaining elastic enough to hold the collar 1510 against the outer surface of the straw 2100.

Figure 22:
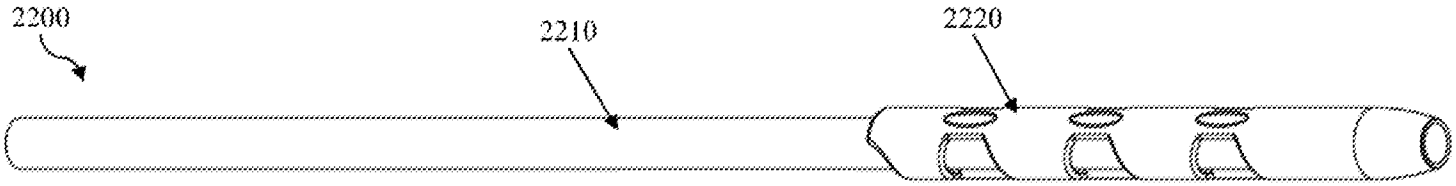
FIG. 22 shows a view of a flute straw in accordance with a thirteenth embodiment.

FIG. 22 shows a view of a flute straw 2200 in accordance with a thirteenth embodiment. The flute straw 2200 includes two portions—a straw body 2210 and a wrapper 2220. When used the flute straw 2200 provides a comfortable drinking experience which offers additional safety benefits. By aerating the fluids moving through the flute straw 2200, the user can safely drink hot liquids. Additionally, the flute straw 2200 is configured so that when used in the default state (for example, when drinking without holding the straw) the maximum amount of aeration is provided so that the user is less likely to accidently burn or scald themselves. Another safety feature is that when the straw body 2210 and wrapper 2220 are misaligned, there is a large amount of aeration to likewise prevent accidental burning or scalding.

The straw body 2210 may be made of durable material that can withstand multiple cycles of a dishwasher, such as, porcelain, ceramics, metal, glass, borosilicate glass, hard plastics, stone, or a combination of such materials. The wrapper 2220 may be made of pliant materials, such as rubber, nylon, etc. The straw body 2210 and/or the wrapper 2220 may also include additional elements, such as a pattern, a logo, a textured surface, etc.

Figure 23:
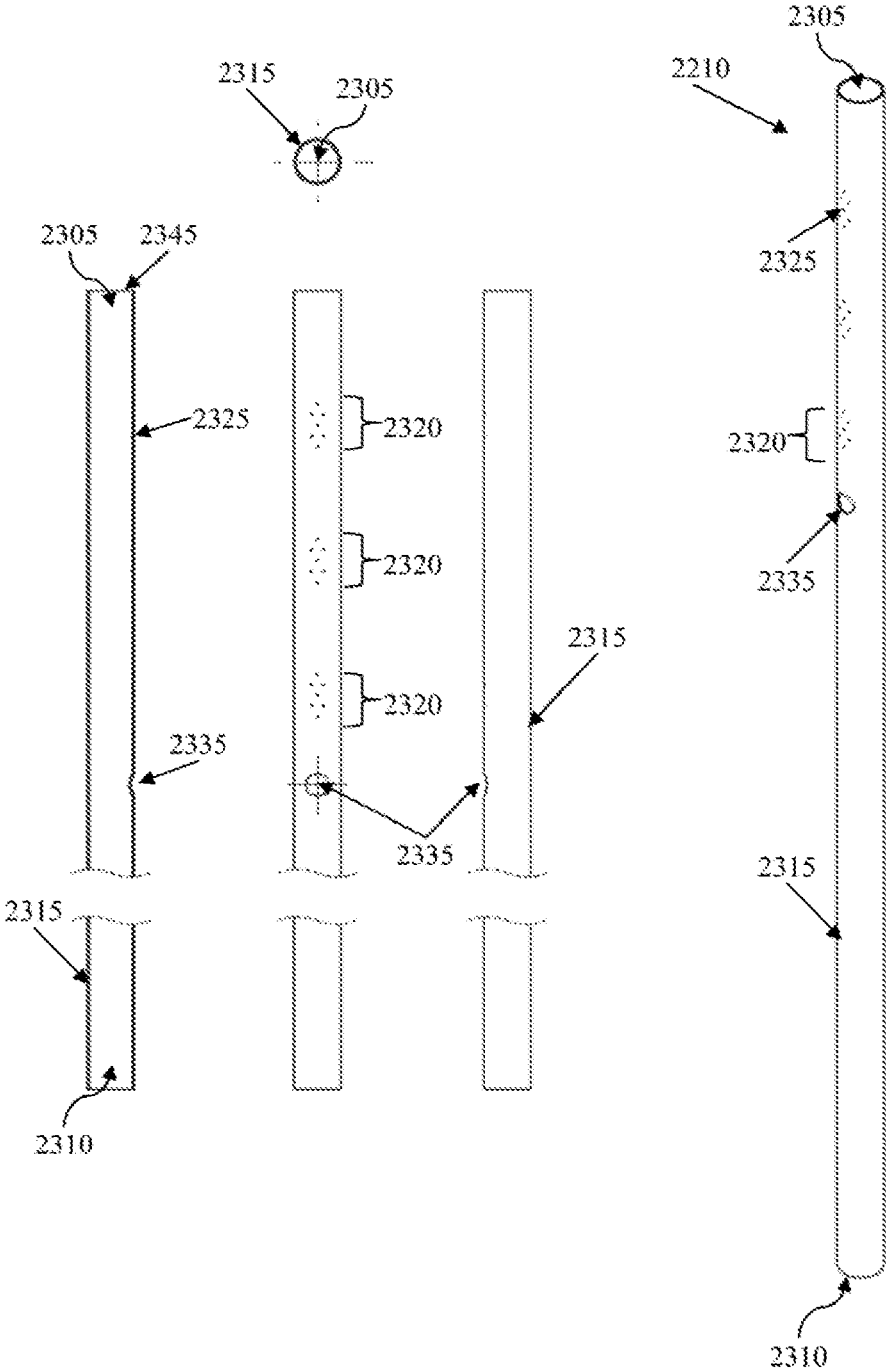
FIG. 23 shows views of the straw portion of the flute straw in accordance with the thirteenth embodiment.

FIG. 23 shows views of the straw body 2210 of the flute straw 2200. The straw body 2210 has a straw upper end 2305 and a straw lower end 2310. During use, the straw lower end 2310 would be directed at or submerged in a fluid, such as coffee, water, etc. and the upper straw edge 2345 on the straw upper end 2305 would be directed at the user.

The straw body 2210 includes a straw wall 2315 with one or more aeration areas 2320. In this non-limiting embodiment, there are three aeration areas 2320; however, in other embodiments there may be two or four aeration areas 2320.

Each aeration area 2320 provides a passageway for air to be drawn into the straw body 2210. In this non-limiting embodiment, a series of aeration holes 2325 provides this passageway. In other embodiments, this passageway may be provided by a screen, a porous material, an air-permeable membrane or another structure which facilitates the creation of many tiny bubbles, such as a porous plastic, porous polymer fibers, porous glass fibers, Porex or Tyvek.

The straw body 2210 also includes one or more alignment opening 2335. The alignment opening 2335 operates with the wrapper 2220 so as to ensure the wrapper 2220 is properly aligned with the aeration areas 2320. This is explained in further detail with regards to FIG. 27.

Figure 24:
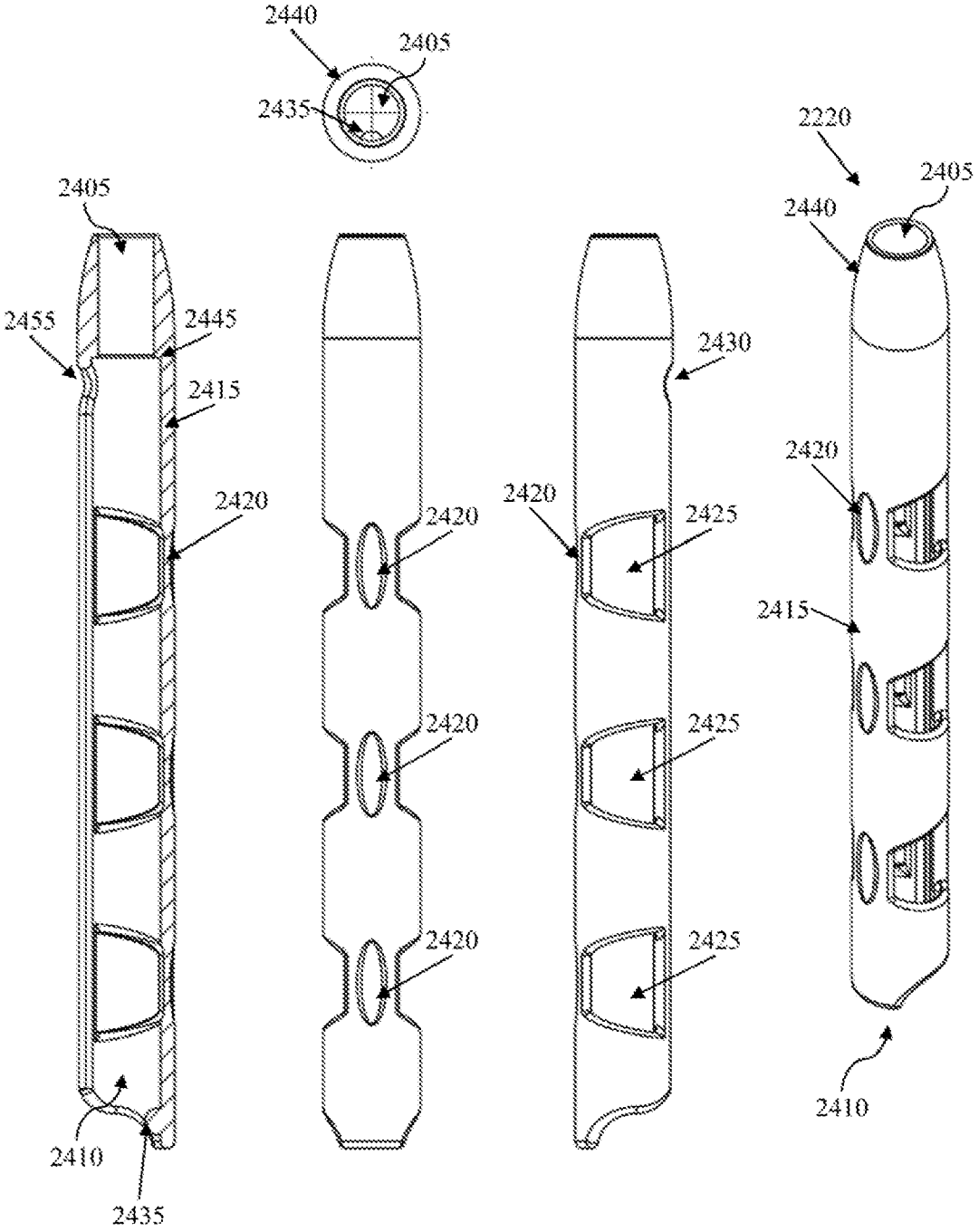
FIG. 24 shows views of the wrapper portion of the flute straw in accordance with the thirteenth embodiment.

FIG. 24 shows views of the wrapper 2220 of the flute straw 2200. The wrapper 2220 has a wrapper wall 2415 extending from a wrapper upper end 2405 having a mouthpiece 2440 to a wrapper lower end 2410. Along the length of the wrapper 2220 are one or more finger pads 2420 with each finger pad 2420 having an associated side opening 2425. On the side opposite the finger pads 2420 is a side opening 2425 and a side groove 2450 (shown in further detail in FIG. 26).

Located on the interior surface of the wrapper wall 2415 is an alignment protrusion 2435 and an interior shoulder 2445. When used with the straw body 2210, these features ensure the wrapper 2220 and straw body 2210 are properly aligned.

In another non-limiting embodiment, there may be an alternative number of finger pads 2420, e.g., five (5) or two (2) finger pads 2420. Furthermore, the side openings 2425 may be larger so as to be associated with more than one finger pad 2420. Each of the side openings 2425 may also be located along only one side, for example, all side openings 2425 may be present on the same side, or the side openings 2425 may alternate sides. Additionally, the side openings 2425 may include a screen, a porous material, an air-permeable membrane and/or other material allowing airflow into the space between the wrapper 2220 and straw body 2210, the aeration gap 2520 as shown in FIGS. 25-28.

Figure 25:
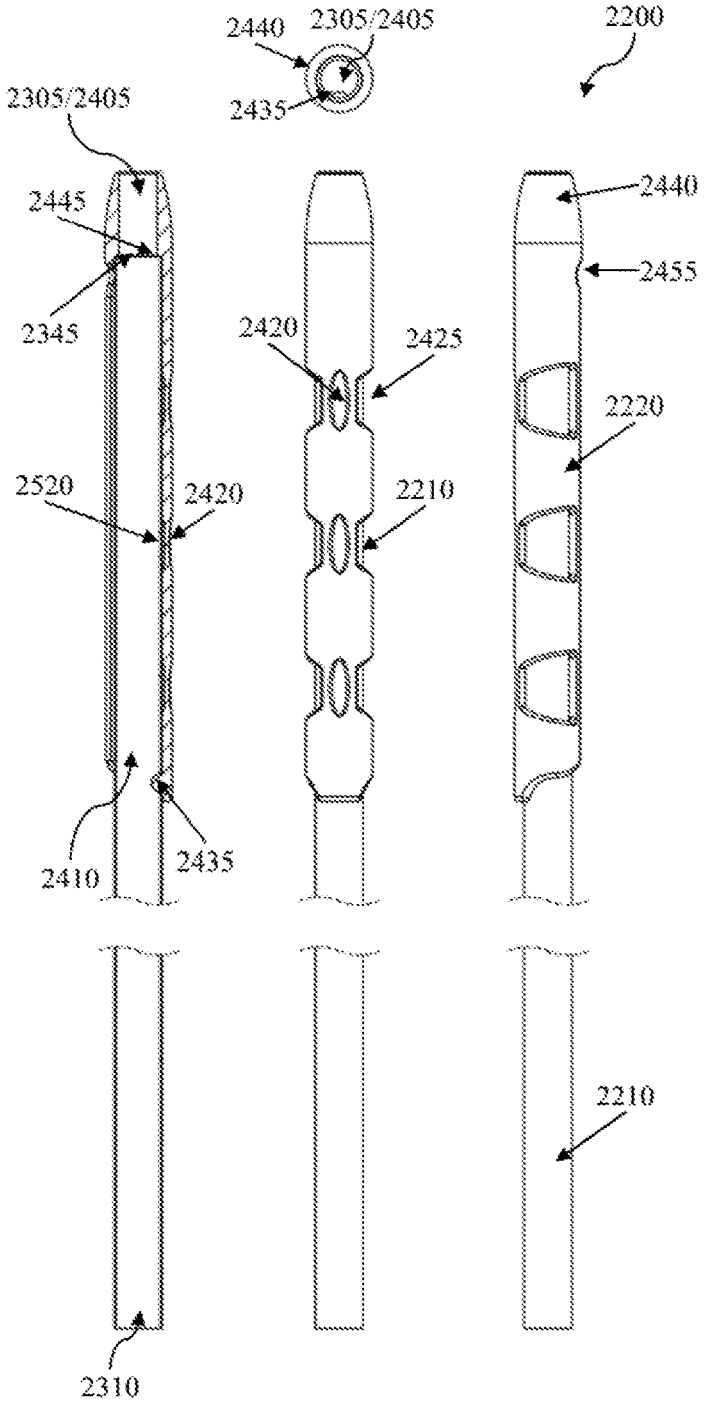
FIG. 25 shows additional views of the flute straw in accordance with the thirteenth embodiment.

FIG. 25 shows additional views of the flute straw 2200. Here, the wrapper 2220 is in place on the straw body 2210. The upper straw edge 2345 at the straw upper end 2305 is placed adjacent to the interior shoulder 2445 near the wrapper upper end 2405. This ensures the aeration areas 2320 are located at the same approximate location as the finger pads 2420.

The wrapper lower end 2410 is positioned towards the straw lower end 2310. When aligned properly, the alignment protrusion 2435 matches with the alignment opening 2335 and resists rotation or movement of the wrapper 2220 along the length of the straw body 2210.

The wrapper 2220 is configured so that an aeration gap 2520 allows the flow of air from outside the flute straw 2200, through the side openings 2425 and into the interior of the straw body 2210 via the aeration hole 2325. This allows aeration of a fluid being drawn through the flute straw 2200.

Figure 26:
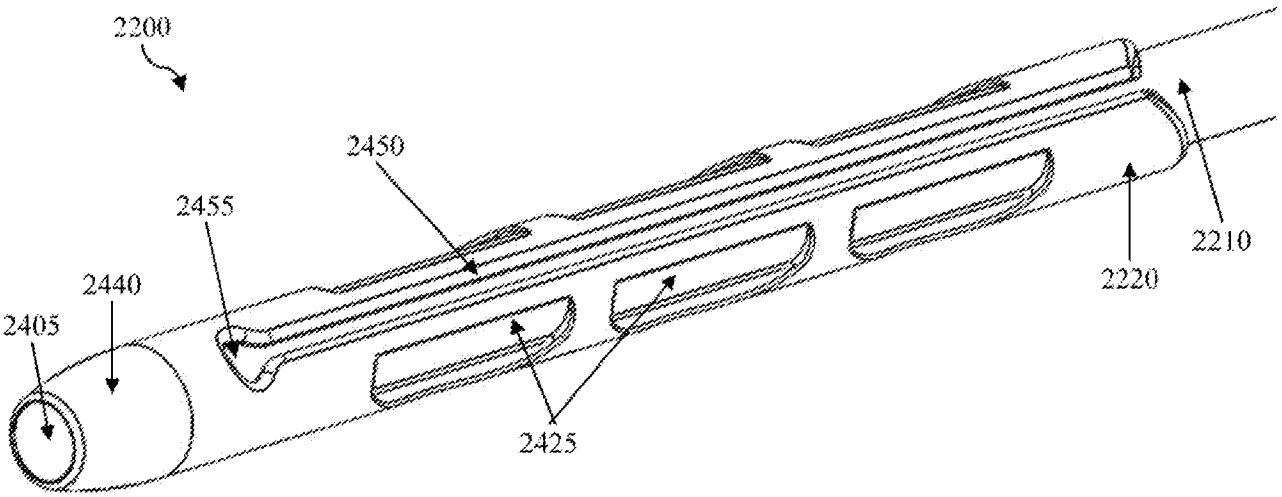
FIG. 26 shows a close-up view of the drinking end of the flute straw in accordance with the thirteenth embodiment.

FIG. 26 shows a close-up view of the drinking end of the flute straw 2200. This end includes the mouthpiece 2440 of the wrapper 2220 at the wrapper upper end 2405. This view shows the reverse side of the flute straw 2200 opposite the finger pads 2420. A side groove 2450 extends for at least part of the length of the wrapper 2220 ending in a groove opening 2455. The side groove 2450 and groove opening 2455 aid in assembling and disassembling the straw body 2210 and the wrapper 2220 as they allow the flexible material of the wrapper 2220 to be opened. This also assists when removing the alignment protrusion 2435 from the alignment opening 2335 in order to disassemble the flute straw 2200, for example, for cleaning.

Figure 27:
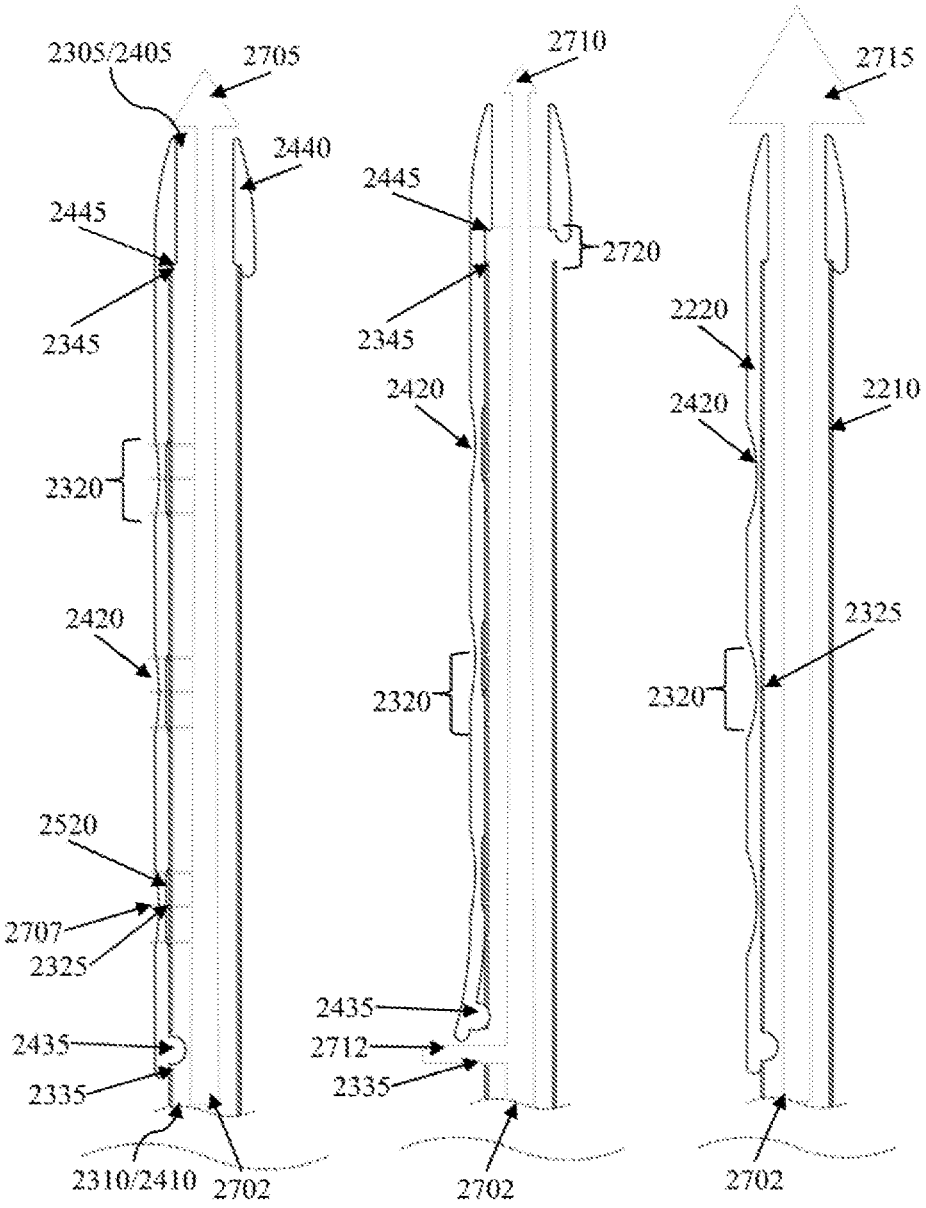
FIG. 27 shows cut-away views of the flute straw in accordance with the thirteenth embodiment.
Figure 28:
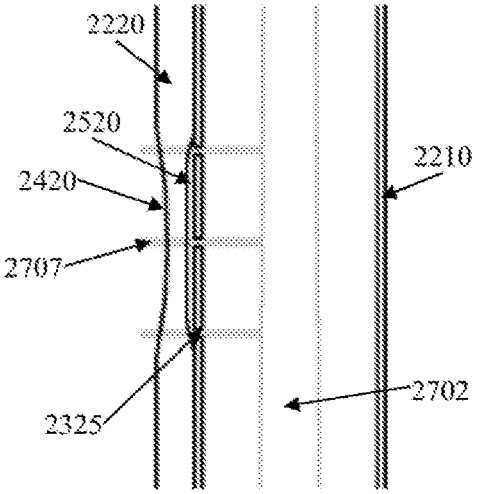
FIG. 28 shows a close-up, cut-away view of the flute straw in accordance with the thirteenth embodiment.

FIG. 27 shows cut-away views of the flute straw 2200 in order to demonstrate the aeration of fluid traveling through the flute straw 2200. Fluid is drawn up through the interior of the straw body 2210, shown as the liquid intake 2702 which enters at the straw lower end 2310. The fluid is pulled up past the straw upper end 2305 and the mouthpiece 2440 of the wrapper 2220 for the user to drink.

Each finger pad 2420 may left in a default position or may be pressed in order to alter the amount of aeration is allowed for a liquid being drawn through the flute straw 2200. When in the default position, air (an aeration intake 2707) may be drawn through an associated aeration gap 2520 and into the interior of the straw body 2210 via the aeration holes 2325 (as shown in higher detail in FIG. 28). In this non-limiting embodiment, by pressing down on the finger pad 2420, the material of the wrapper is forced down over the aeration holes 2325 and preventing aeration. Thus, by selectively pressing the finger pads 2420, the wrapper 2220 may be used to control the amount of aeration while providing an additional level of safety preventing accidentally taking non-aerated liquid.

In this non-limiting embodiment, the straw body 2210 and the wrapper 2220 include various features to ensure that the finger pads 2420 of the wrapper 2220 are properly aligned over the aeration areas 2320 of the straw body 2210.

Transverse alignment along the length of the straw body 2210 and the wrapper 2220 is ensured by the upper straw edge 2345 of the straw body 2210 and the interior shoulder 2445 of the wrapper 2220. When assembled, the upper straw edge 2345 abuts the interior shoulder 2445 preventing over-insertion. When not fully inserted, an alignment gap 2720 exists between the upper straw edge 2345 and the interior shoulder 2445. This alignment gap 2720 may be configured to draw in additional air in order to further aerate the fluid traveling through the straw body 2210.

Rotational alignment (as well as transverse alignment) is provided by the alignment opening 2335 of the straw body 2210 and the alignment protrusion 2435 of the wrapper 2220. The alignment protrusion 2435 is able to seat within the alignment opening 2335 when the straw body 2210 and the wrapper 2220 are properly aligned.

Based on the amount of air allowed into the fluid, the user may be provided minimally aerated liquid 2715, fully aerated liquid 2705, or some amount of aeration in between. When the wrapper 2220 is not properly aligned, the alignment protrusion 2435 does not block the alignment opening 2335 and the safety aeration intake 2712 of air is allowed to aerate the fluid resulting in the user being provided an alignment correction output 2710. The amount of aeration in the alignment correction output 2710 may be approximately equal to the amount of aeration in the fully aerated liquid 2705. In other embodiments, the amount of aeration in the alignment correction output 2710 may be more than or less than to the amount of aeration in the fully aerated liquid 2705. This adds a further level of safety preventing accidentally taking non-aerated liquid which, in the case of a hot liquid, would otherwise scald or burn the user.

The side groove 2450 provides 1) ease of cleaning of the interior of the straw, 2) facilitates easy install and removal and 3) enables the misalignment safety feature. If the wrapper 2220 were closed, for example, with no side groove 2450, this misalignment safety feature might not work as the straw body 2210 and wrapper 2220 could create a non-aerated condition with the aeration areas 2320 being obscured by the wrapper wall 2415, such as if the wrapper 2220 where rotated 180°. However, with the side groove 2450, this rotated orientation would not obscure the aeration areas 2320. Likewise, the alignment protrusion 2435 and alignment opening 2335 also prevent a non-aerated condition from occurring.

An embodiment of the flute straw provides a variable aerating straw. The flute straw includes a straw body and a wrapper. The straw body defines a flow space configured to allow fluid to flow through the drinking straw, at least one aeration area, and an alignment opening. The wrapper includes at least one finger pad and an alignment protrusion. The wrapper is configured to enclose at least one end of the straw body and the alignment protrusion is configured to seat within the alignment opening when the wrapper is properly aligned over the straw body. Each of the at least one finger pad is configured to occlude an associated aeration area when the finger pad is pressed. The straw body and the wrapper are configured to enable air flow into the flow space through any non-occluded aeration area when fluid is flowing through the flow space so as to aerate the fluid.

In a further embodiment of the drinking straw above, the drinking straw also includes an air-permeable membrane.

In another embodiment of any one of the drinking straws above, the drinking straw also includes a mesh or a porous material disposed in the aeration holes.

Using a slider, the aerating straw may be changed intuitively by the user between cooling (or aerating) and non-cooling (or non-aerating). When open, air can pass through a large hole in the cover exposed by the slider, and then through the smaller holes in the straw body into the straw. The cover can seal against straw body but leave an open chamber over the holes in the straw body.

An array of holes in the straw body can allow incorporation of air into the liquid during drinking without excessive noise. Incorporation of air is used to cool the liquid as well as to create a mixture of air and liquid that reduces the likelihood of burning the mouth during use. In some embodiments, the holes may be less than 0.0135" in order to be sufficiently quiet. Hole size also ensure incorporating air without a significant pressure drop. The pressure drop relates to how difficult it is for the user to suck liquid up. The chosen hole size can allow incorporation of sufficient air without making the straw difficult to use.

The array of holes may be provided with various potential configurations. There may be fourteen holes in an offset array. However, there may be more, or less holes, for example, between five and twenty-five holes.

Figure 29:
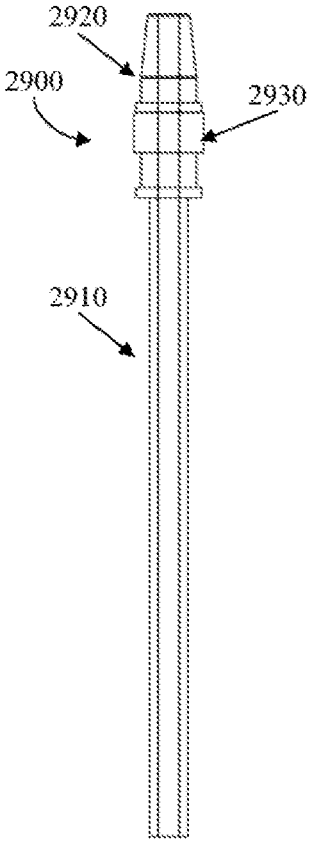
FIG. 29 shows a view of a straw body, cover and slider in a non-aerating position in accordance with a fourteenth embodiment.
Figure 30:
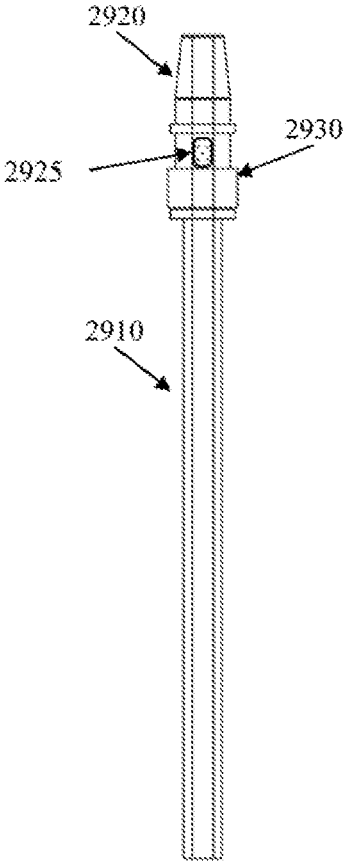
FIG. 30 shows a view of the straw body, cover and slider in an aerating position in accordance with the fourteenth embodiment.

FIG. 29 shows a view of a straw body 2910, straw cover 2920 and slider 2930 in a non-aerating position in accordance with a fourteenth embodiment of the straw 2900 and FIG. 30 shows a view of the straw body 2910, straw cover 2920 and slider 2930 in an aerating position in accordance with the fourteenth embodiment of the straw 2900. In the aerating position of FIG. 29, the slider 2930 covers aeration opening 2925 so that no air is allowed to enter the straw body 2910. In the non-aerating position of FIG. 30, the aeration opening 2925 is unobstructed and air is able to enter the straw body 2910.

The straw body 2310 may be made of porcelain, ceramics, metal, glass, borosilicate glass, hard plastics, and/or stone. The straw cover 2920 may be made of silicone, neoprene, thermoplastic elastomer (TPE) and/or flexible rubber.

Figure 31:
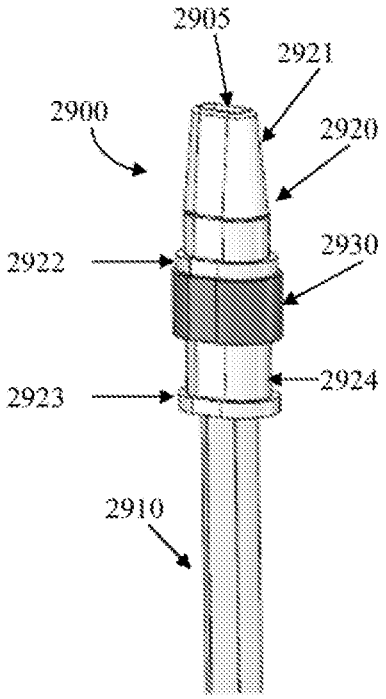
FIG. 31 shows another view of the straw body, cover and slider in the non-aerating position in accordance with the fourteenth embodiment.
Figure 32:
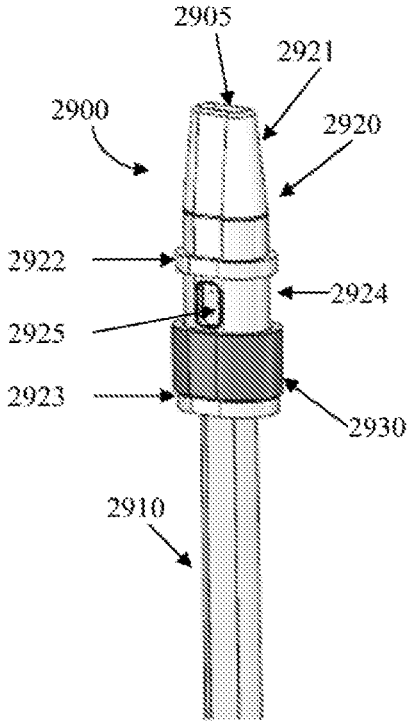
FIG. 32 shows another view of the straw body, cover and slider in the aerating position in accordance with the fourteenth embodiment.

FIG. 31 shows another view of the straw body 2910, straw cover 2920 and slider 2930 in the non-aerating position in accordance with the fourteenth embodiment of the straw 2900 and FIG. 32 shows another view of the straw body 2910, straw cover 2920 and slider 2930 in the aerating position in accordance with the fourteenth embodiment of the straw 2900. The straw cover 2920 defines a slider area 2924 which limits the movement of the slider 2930 with an upper shoulder 2922 and lower shoulder 2923. At the top of the straw cover 2920 is a mouthpiece 2921 which defines an upper opening 2905.

In one non-limiting embodiment, the mouthpiece 2921 is made of a separable element which can be removed for cleaning. Alternatively, the mouthpiece 2921 may be unitary with the straw cover 2920.

In the aerating position of FIG. 31, the slider 2930 abuts the upper shoulder 2922 and covers aeration opening 2925 so that no air is allowed to enter the straw body 2910. In the non-aerating position of FIG. 32, the slider 2930 touches the lower shoulder 2923 and the aeration opening 2925 is unobstructed so that air is able to enter the straw body 2910.

In one non-limiting embodiment, the straw cover 2920 and slider 2930 may have features which secure the slider 2930 in place, for example, a groove and complementary protrusion.

Figure 33:
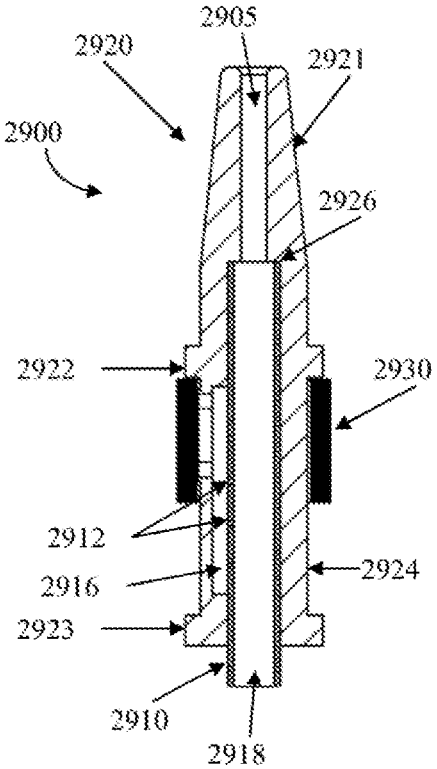
FIG. 33 shows a cross-section view of the straw body, cover and slider in the non-aerating position in accordance with the fourteenth embodiment.
Figure 34:
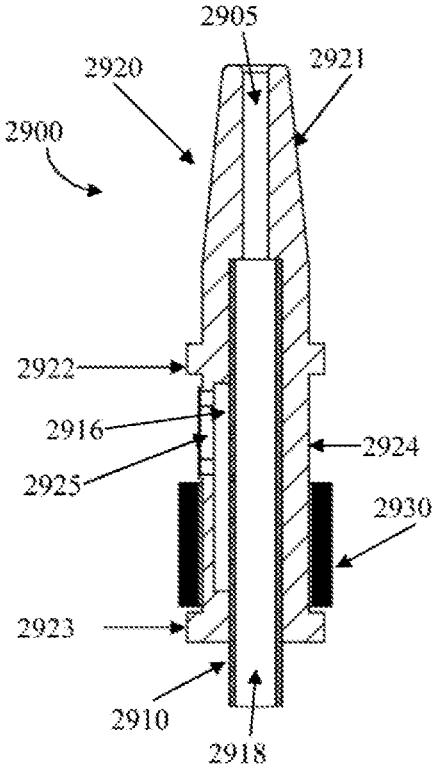
FIG. 34 shows a cross-section view of the straw body, cover and slider in the aerating position in accordance with the fourteenth embodiment.

FIG. 33 shows a cross-section view of the straw body 2910, straw cover 2920 and slider 2930 in the non-aerating position in accordance with the fourteenth embodiment of the straw 2900 and FIG. 34 shows a cross-section view of the straw body 2910, straw cover 2920 and slider 2930 in the aerating position in accordance with the fourteenth embodiment of the straw 2900. The straw body 2910 and straw cover 2920 define an aeration gap 2916 which allows air to flow through aeration holes 2912 into the flow space 2918. When in the non-aerating position of FIG. 33, the slider 2930 creates a seal with the straw cover 2920 which prevents air from flowing into the aeration gap 2916. In contrast, when in the aerating position of FIG. 34, the aeration opening 2925 is clear and air can aerate fluid flowing through the flow space 2918.

Figure 36:
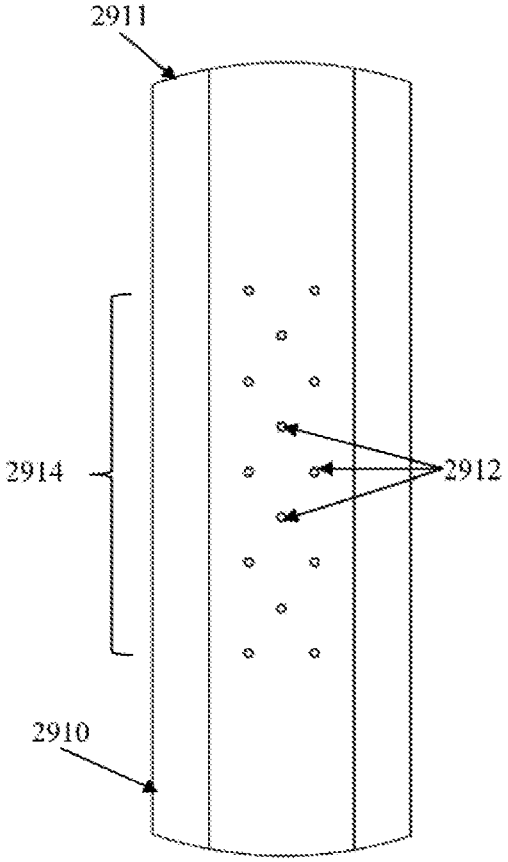
FIG. 36 shows a close-up view of an aeration area of the straw body in accordance with the fourteenth embodiment.

As show, the straw cover 2920 includes an inner shoulder 2926 which abuts against the upper edge 2911 of the straw body 2910 (see FIG. 36). In an alternative embodiment, the inner shoulder 2926 and upper edge 2911 may include features which align the straw cover 2920 and the straw body 2910 in order to ensure proper aeration.

Figure 35:
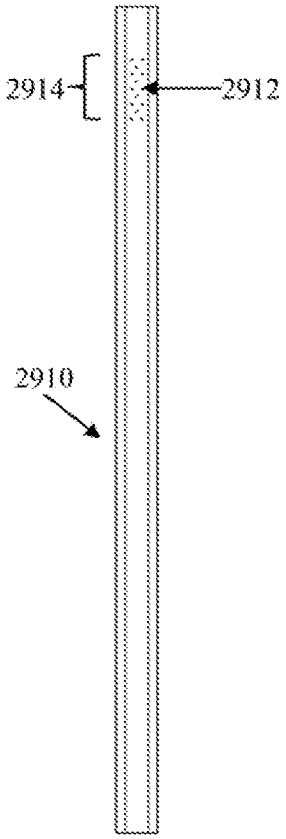
FIG. 35 shows a view of the straw body in accordance with the fourteenth embodiment.

FIG. 35 shows a view of the straw body 2910 in accordance with the fourteenth embodiment of the straw 2900 and FIG. 36 shows a close-up view of an aeration area 2914 of the straw body 2910 in accordance with the fourteenth embodiment of the straw 2900. A series of aeration holes 2912 define an aeration area 2914. The size, placement, shape and arrangement of the aeration holes 2912 may be selected so as to reduce any sound created by the aeration of fluid.

Figure 37:
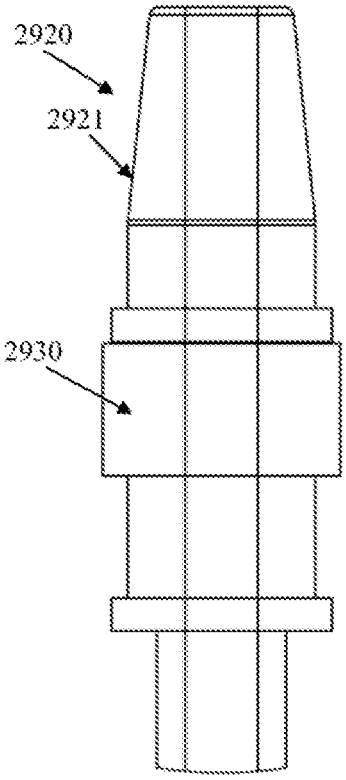
FIG. 37 shows a view of the cover and straw body in the non-aerating position in accordance with the fourteenth embodiment.
Figure 38:
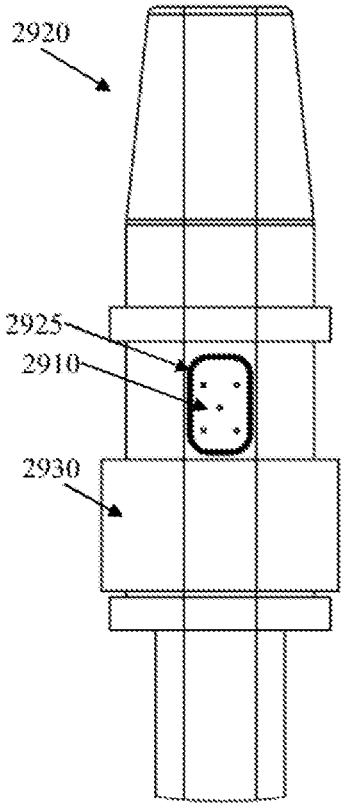
FIG. 38 shows a view of the cover in the aerating position in accordance with the fourteenth embodiment.

FIG. 37 shows a view of the cover 2920 and straw body 2910 in the non-aerating position in accordance with the fourteenth embodiment of the straw 2900 and FIG. 38 shows a view of the cover 2920 in the aerating position in accordance with the fourteenth embodiment of the straw 2900.

In another embodiment, the aerating straw may have a plug to change between cooling (or aerating) and non-cooling (or non-aerating). When open, air can pass through a large hole in the cover exposed by the plug, and then through the smaller holes in the straw body into the straw. The plug can include two protrusions, one to seal against the cover preventing aeration and the other to hold the plug secured when in the open configuration.

Figure 39:
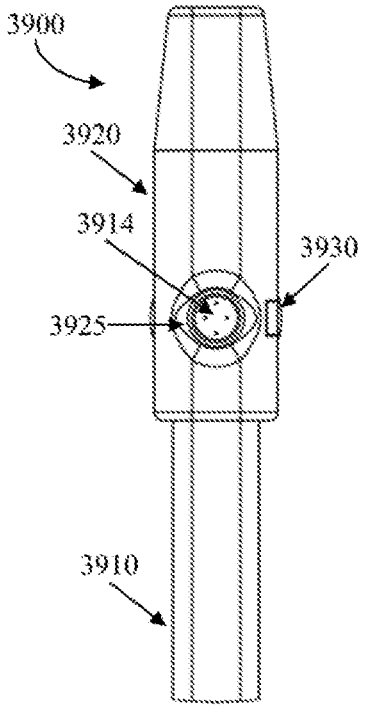
FIG. 39 shows a view of a straw body, cover and plug in a first aerating position in accordance with the fifteenth embodiment.

FIG. 39 shows a view of a straw body 3910, straw cover 3920 and plug 3930 in a first aerating position in accordance with the fifteenth embodiment of the straw 3900. The straw body 3910 includes an aeration opening 3925 which, when unobstructed, allows air to flow into the aeration area 3914. A plug 3930 is secured to the opposite side of the straw cover 3920.

Figure 40:
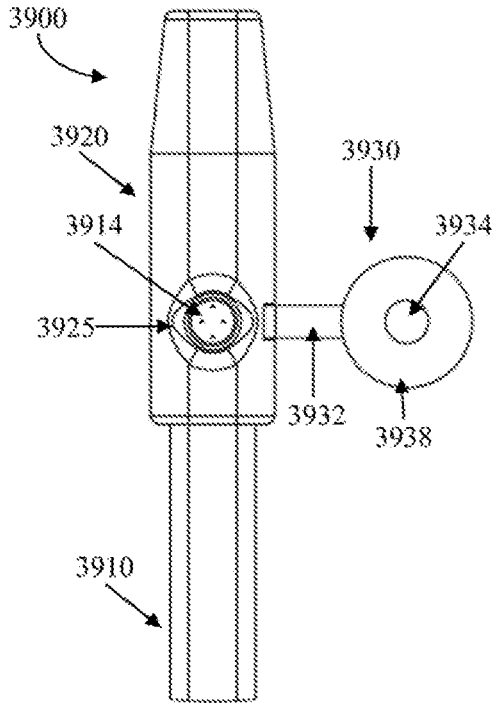
FIG. 40 shows a view of the straw body, cover and plug in a second aerating position in accordance with the fifteenth embodiment.
Figure 41:
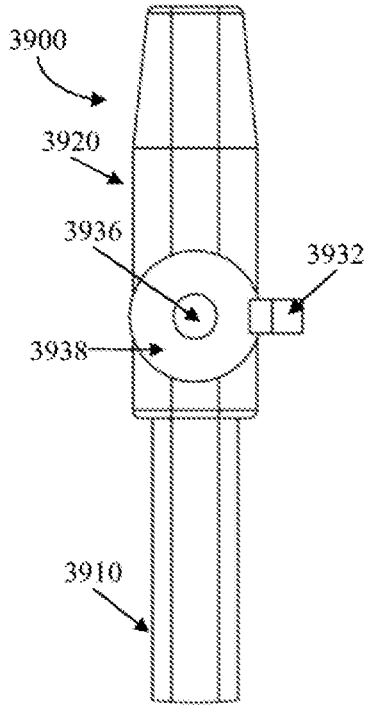
FIG. 41 shows a view of the straw body, cover and plug in a non-aerating position in accordance with the fifteenth embodiment.

FIG. 40 shows a view of the straw body 3910, straw cover 3920 and plug 3930 in a second aerating position in accordance with the fifteenth embodiment of the straw 3900. In this position, the plug 3930 is secured to the straw cover 3920 by a hinge 3932. FIG. 41 shows a view of the straw body 3910, straw cover 3920 and plug 3930 in a non-aerating position in accordance with the fifteenth embodiment of the straw 3900.

The plug body 3938 has a first protrusion 3934 and a second protrusion 3936. The first protrusion 3934 can be used to secure the plug 3930 to the straw cover 3920 as shown in FIG. 41. In this position, the first protrusion 3934 seals aeration opening 3925 and prevents air from entering the flow space 3918 (see FIGS. 45 and 46).

Figure 42:
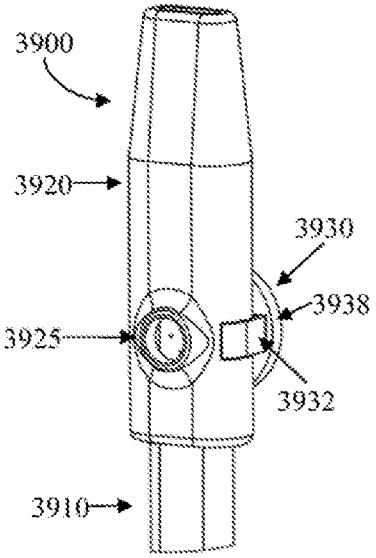
FIG. 42 shows another view of the straw body, cover and plug in the first aerating position in accordance with the fifteenth embodiment.
Figure 43:
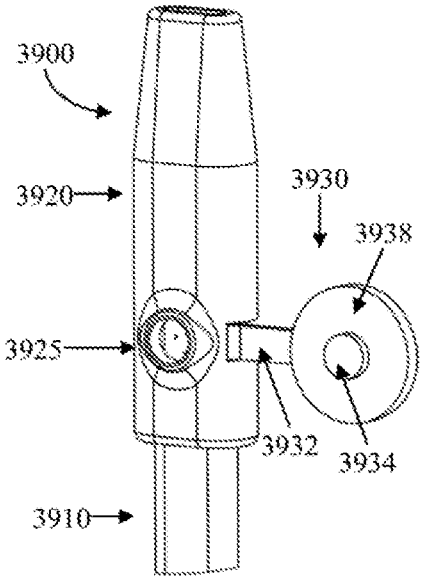
FIG. 43 shows another view of the straw body, cover and plug in the second aerating position in accordance with the fifteenth embodiment.
Figure 44:
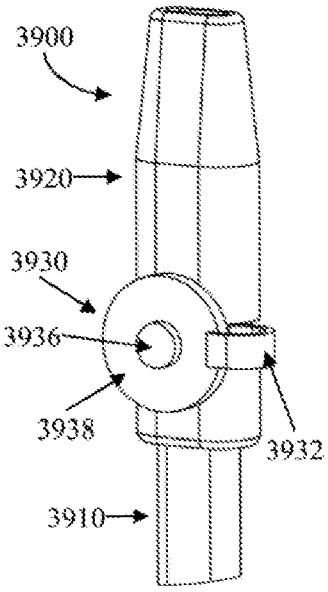
FIG. 44 shows another view of the straw body, cover and plug in the non-aerating position in accordance with the fifteenth embodiment.

In a non-limiting embodiment, the hinge 3932 may be a living hinge. In a further non-limiting embodiment, the hinge 3932 may be replaced with a cord or tether. Such a plug 3930 The may omit the second protrusion 3936 and use the first protrusion 3934 to secure the plug in either the aerating position or the non-aerating position. FIG. 42 shows another view of the straw body 3910, straw cover 3920 and plug 3930 in the first aerating position, FIG. 43 shows another view of the straw body 3910, straw cover 3920 and plug 3930 in the second aerating position and FIG. 44 shows another view of the straw body 3910, straw cover 3920 and plug 3930 in the non-aerating position in accordance with the fifteenth embodiment of the straw 3900.

Figure 45:
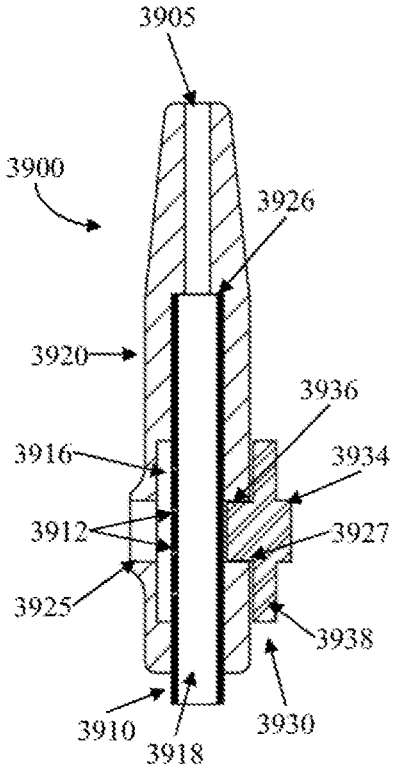
FIG. 45 shows a cross-section view of the straw body, cover and plug in the aerating position in accordance with the fifteenth embodiment.
Figure 46:
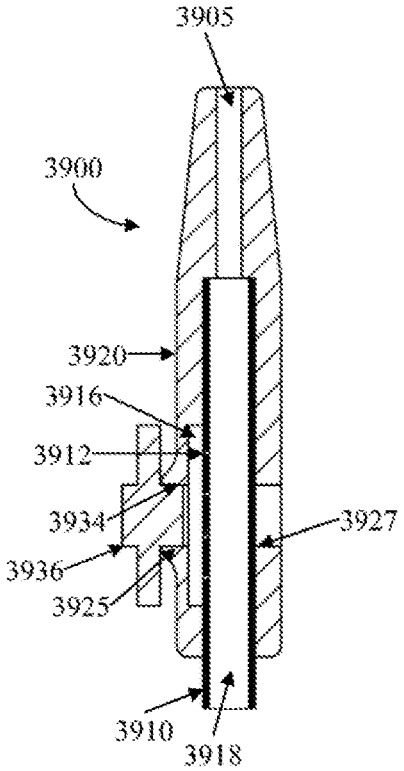
FIG. 46 shows a cross-section view of the straw body, cover and plug in the non-aerating position in accordance with the fifteenth embodiment.

FIG. 45 shows a cross-section view of the straw body 3910, straw cover 3920 and plug 3930 in the aerating position in accordance with the fifteenth embodiment of the straw 3900 and FIG. 46 shows a cross-section view of the straw body 3910, straw cover 3920 and plug 3930 in the non-aerating position in accordance with the fifteenth embodiment of the straw 3900. The straw body 3910 and straw cover 3920 define an aeration gap 3916 which allows air to flow through aeration holes 3912 into the flow space 3918. When in the non-aerating position of FIG. 46, the first protrusion 3934 of plug 3930 creates a seal with the straw cover 3920 which prevents air from flowing into the aeration gap 3916. In contrast, when in the aerating position of FIG. 46, the aeration opening 3925 is clear and air can aerate fluid flowing through the flow space 3918. In the aerating position of FIG. 46, the second protrusion 3936 of plug 3930 secures the plug 3930 in a non-aeration opening 3927.

In another non-limiting embodiment, the plug 3930 may be disconnected from the straw cover 3920 and able to be detached completely from the straw 3900. The plug 3930 may omit the second protrusion 3936 and use the first protrusion 3934 to secure the plug to either the aeration opening 3925 or the non-aeration opening 3927.

In a further non-limiting embodiment, the aeration opening 3925 may be configured to produce an air-tight seal when the user's finger is placed against the aeration opening 3925. This non-limiting embodiment may include a detachable plug 3930 (e.g., in order to ensure functionality of the straw 3900 even without the plug 3930) or omit the plug 3930 entirely. Additionally, in the embodiment where the plug 3930 is omitted, the straw cover 3920 may also omit the non-aeration opening 3927.

In one non-limiting embodiment, the non-aeration opening 3927 may define a similar gap to the aeration gap 3916. In such an embodiment, the straw body 3910 may be rotated 180° so that the aeration opening 3925 and the non-aeration opening 3927 switch roles.

The foregoing description has been directed to particular embodiments. However, other variations and modifications may be made to the described embodiments, with the attainment of some or all of their advantages. It will be further appreciated by those of ordinary skill in the art that modifications to the above-described systems and methods may be made without departing from the concepts disclosed herein. Accordingly, the invention should not be viewed as limited by the disclosed embodiments. Furthermore, various features of the described embodiments may be used without the corresponding use of other features. Thus, this description should be read as merely illustrative of various principles, and not in limitation.

LISTING OF PARTS

110 straw
112 upper end
114 lower end
120 aeration holes
122 uncovered aeration holes
124 covered aeration holes
130 slotted collar
132 slot
210 straw
220 first aeration holes
222 second aeration holes
230 slotted collar
232 slot
234 shoulder
236 mouthpiece
330 solid collar
400 cup
440 liquid
500 bubbles
830 slotted collar
832 slot
834 mesh
1110 straw
1112 upper end
1114 lower end
1120 mesh covered holes
1200 straw
1210 lower end
1211 "0" position indicator
1213 "2" position indicator
1215 "1" position indicator
1220 upper end
1221 first side
1223 second side
1224 large slot
1225 third side
1226 small slot
1230 shoulder
1300 collar
1310 pointer
1321 first interior side
1323 second interior side
1324 mesh
1325 third interior side
1330 edge
1510 ring collar
1512 elastic membrane
1515 mesh
1520 straw
1530 clamp collar
1532 first clamp collar side
1534 second clamp collar side
1535 mesh
1600 clamp cover
1610 first edge
1612 second edge
1620 interior surface
1630 exterior surface
1632 graphic
1710 straw
1712 flat surface
1714 aeration hole
1720 collar
1722 mesh
1730 clamp cover
1740 opening
1800 clamp cover
1810 first edge
1812 first shoulder
1820 second edge
1822 second shoulder
1830 narrow section
1832 gap
1840 inner circumference
1900 partial covered configuration
1910 collar
1912 mesh
2000 fully covered configuration
2005 partial covered configuration
2010 collar
2012 mesh
2020 straw
2022 position indicators
2024 grooves
2032 uncovered aeration holes
2034 covered aeration holes
2100 straw
2110 lower end
2115 first shoulder
2120 mid-section
2122 aeration opening
2125 second shoulder
2130 upper end
2200 flute straw
2210 straw body
2220 wrapper
2305 straw upper end
2310 straw lower end
2315 straw wall
2320 aeration area
2325 aeration hole
2335 alignment opening
2345 upper straw edge
2405 wrapper upper end
2410 wrapper lower end
2415 wrapper wall
2420 finger pad
2425 side opening
2435 alignment protrusion
2450 side groove
2455 groove opening
2440 mouthpiece
2445 wrapper interior shoulder
2520 aeration gap
2702 liquid intake
2705 fully aerated liquid
2707 aeration intake
2710 alignment correction output
2712 safety aeration intake
2715 minimally aerated liquid
2720 alignment gap
2900 straw
2905 upper opening
2910 straw body

2911 upper edge
2912 aeration holes
2914 aeration area
2916 aeration gap
2918 flow space
2920 straw cover
2921 mouthpiece
2922 upper shoulder
2923 lower shoulder
2924 slider area
2925 aeration opening
2926 inner shoulder
2930 slider
3900 straw
3905 upper opening
3910 straw body
3912 aeration holes
3914 aeration area
3916 aeration gap
3918 flow space
3920 straw cover
3925 aeration opening
3926 inner shoulder
3927 non-aeration opening
3930 plug
3932 hinge
3934 first protrusion
3936 second protrusion
3938 plug body

What is claimed is:

1. A drinking straw comprising:

a straw body defining: a flow space configured for allowing fluid to flow through the drinking straw, the straw body including a straw wall with an aeration area configured for providing a passageway for air selectively to be drawn into the flow space of the straw body; and a straw cover fluidically open at an upper end and a lower end and having a barrier portion corresponding to at least a portion of the aeration area;

wherein the straw cover is configured to enclose selectively at least one end of the straw body;

wherein the aeration area comprises an array of aeration holes;

wherein the barrier portion has a plurality of finger pads each including a finger pad surface which is recessed relative to a surface of the straw which encircles the finger pad;

wherein each finger pad when aligned opposing the aeration area corresponds to at least one corresponding aeration hole included in the array of aeration holes;

wherein each of the plurality of finger pads has a default configuration which defines an associated aeration gap between the surface of the finger pad and the at least corresponding aeration hole thereby enabling air flow through the associated aeration gap into the flow space via the at least one corresponding aeration hole; and wherein each of the plurality of finger pads has a non-default configuration whereby a material of the finger pad eliminates the associated aeration gap between the surface of the finger pad and the corresponding at least one aeration hole thereby preventing air flow through the associated aeration gap into the flow space via the corresponding at least one aeration hole.

2. The drinking straw of claim 1, wherein the straw body and the straw cover are configured to dampen sound created by the aeration of the fluid when the barrier is in the default configuration.

3. The drinking straw of claim 1, wherein the straw body comprises an air-permeable membrane disposed in the aeration area.

4. The drinking straw of claim 1, wherein the straw body comprises a mesh disposed in the aeration area.

5. The drinking straw of claim 1, wherein the straw body comprises at least one of: porcelain, ceramics, metal, glass, borosilicate glass, hard plastics, and stone.

6. The drinking straw of claim 1, wherein the straw cover comprises at least one of: silicone, neoprene, thermoplastic elastomer and flexible rubber.

7. The drinking straw of claim 1, wherein the straw cover further comprises a mouthpiece disposed at the first end of the straw cover.

8. The drinking straw of claim 1, wherein the straw cover comprises a straw cover alignment component and the straw body comprises a straw body alignment component corresponding to the straw cover alignment component for ensuring proper alignment of the straw cover such that rotation of the straw cover about the straw body and movement of the straw cover along a length of the straw body is resisted when the straw cover alignment component is aligned with the straw body alignment component; and wherein each of the plurality of finger pads has capacity for assuming the non-default configuration when the straw cover alignment component is aligned with the straw body alignment component such that rotation of the straw cover about the straw body and movement of the straw cover along a length of the straw body is resisted.

9. The drinking straw of claim 1, wherein the straw body comprises a first component having a first color and being made of a first material and a second component having a second color and being made of a second material, wherein the first and second colors and first and second materials include a combination selected from the group consisting of the first material and the second material are the same material, the first material and the second material are different materials, the first color and the second color are the same color, the first color and the second color are different colors, and a combination of at least two of the aforementioned.

10. The drinking straw of claim 1, wherein the straw cover has an opening being configured for allowing a flow of air from outside the drinking straw through the opening and the aeration area into the flow space of the straw body; and a detachable plug for selectively sealing the opening.

11. The drinking straw of claim 10, wherein the detachable plug has a first protrusion configured to securely seal the opening with the detachable plug; and a second protrusion configured to hold the plug secured when in the open configuration.

12. The drinking straw of claim 10, wherein the detachable plug comprises a tether connecting the detachable plug to the straw cover.

13. The drinking straw of claim 10, wherein the opening comprises at least one of a screen, a porous material, an air-permeable membrane, a material for allowing air flow into a space between the straw cover and the straw body.

14. The drinking straw of claim 1, wherein the straw cover is selectively removeable from the straw body.

15. The drinking straw of claim 1, wherein the aeration area comprises a device for facilitating creation of bubbles selected from the group consisting of a screen, a porous material, an air-permeable membrane, a porous plastic fiber, a porous polymer fiber, a porous glass fiber, a porous Porex fiber, a porous Tyvek fiber, and a combination of at least two of the aforementioned.

16. The drinking straw of claim 1, wherein each of the plurality of finger pads assumes the non-default configuration upon exertion of a selected pressure on the finger pad.

* * * * *